US008948636B2

(12) United States Patent
Kitajima

(10) Patent No.: US 8,948,636 B2
(45) Date of Patent: Feb. 3, 2015

(54) IMAGE FORMING APPARATUS COMPRISING A PLURALITY OF CHARGING ROLLERS

(71) Applicant: Canon Kabushiki Kaisha, Tokyo (JP)

(72) Inventor: Kenichiro Kitajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/074,563

(22) Filed: Nov. 7, 2013

(65) Prior Publication Data

US 2014/0064758 A1 Mar. 6, 2014

Related U.S. Application Data

(63) Continuation of application No. PCT/JP2013/067202, filed on Jun. 24, 2013.

(30) Foreign Application Priority Data

Jul. 2, 2012 (JP) ..... 2012-148961
Jun. 18, 2013 (JP) ..... 2013-127993

(51) Int. Cl.
*G03G 15/02* (2006.01)
*G03G 15/00* (2006.01)

(52) U.S. Cl.
CPC ..... *G03G 15/80* (2013.01); *G03G 15/0283* (2013.01)
USPC ..... 399/50; 399/43; 399/89

(58) Field of Classification Search
USPC ..... 399/50, 43, 168, 176, 128, 129, 89
See application file for complete search history.

(56) References Cited

U.S. PATENT DOCUMENTS

2012/0201553 A1* 8/2012 Hano ..... 399/50

FOREIGN PATENT DOCUMENTS

| | | | |
|---|---|---|---|
| JP | 9-80874 | A | 3/1997 |
| JP | 9-222768 | A | 8/1997 |
| JP | 9-281773 | A | 10/1997 |
| JP | 10-177291 | A | 6/1998 |
| JP | 2007-114418 | A | 5/2007 |
| JP | 2007-334148 | A | 12/2007 |

* cited by examiner

*Primary Examiner* — Sophia S Chen
(74) *Attorney, Agent, or Firm* — Canon USA Inc IP Division

(57) ABSTRACT

A changing voltage is applied to a first charging roller. A voltage obtained by superimposing an alternating voltage on a direct voltage is applied to a second charging roller disposed on the downstream side of the first charging roller in the rotation direction of a photosensitive member. During image formation, the changing voltage applied to the first charging roller is changed so that the magnitude relationship between the potential of the photosensitive member which has been charged by using the first charging roller and which has reached a position at which the photosensitive member is charged by using the second charging roller and the direct voltage applied to the second charging roller is alternately switched.

4 Claims, 17 Drawing Sheets

IMAGE FORMING APPARATUS COMPRISING A PLURALITY OF CHARGING ROLLERS

CROSS-REFERENCE TO RELATED APPLICATIONS

This application is a Continuation of International Patent Application No. PCT/JP2013/067202, filed Jun. 24, 2013, which claims the benefit of Japanese Patent Application No. 2012-148961, filed Jul. 2, 2012 and No. 2013-127993, filed Jun. 18, 2013, which are hereby incorporated by reference herein in their entirety.

TECHNICAL FIELD

The present invention relates to an image forming apparatus, such as a copier or a printer, which uses an electrophotographic scheme.

BACKGROUND ART

In image forming apparatuses of the related art which use electrophotographic schemes, charging means is used to charge an electrophotographic photosensitive member (photosensitive member), and exposure means is used to perform exposure, whereby an electrostatic image is formed on the photosensitive member. The electrostatic image is developed by using developing means to form a toner image on the photosensitive member.

A contact charging scheme in which a charging member which is in contact with or close to an object to be charged is used is widely used as the charging means because an amount of ozone which is smaller than that in a corona charging scheme is produced when discharging is performed. In particular, a charging roller scheme in which a charging roller which is a roller-type charging member is used is widely used. In a typical charging roller scheme, a charging roller which is a roller-shaped charging member is in contact with the surface of a photosensitive member which is an object to be charged, and a voltage (charge voltage) is applied to the charging roller, whereby discharge which occurs in a minute gap between the charging roller and the photosensitive member causes the photosensitive member to be charged.

It is not necessary for the above-described charging member such as a charging roller to be in contact with the surface of the photosensitive member which is an object to be charged. As long as a dischargeable region defined by a gap voltage and a corrected Paschen curve is provided with certainty between a charging roller and a photosensitive member, the charging roller may be disposed in such a manner as to be close to the photosensitive member in a non-contact manner with a gap (space) of, for example, several tens of micrometers interposed therebetween. Herein, a scheme in which a charging roller is in contact with or close to an object to be charged and in which discharge which occurs in a minute gap causes the object to be charged is called a contact or close charging scheme or simply a contact charging scheme.

When a contact charging scheme is used as a charging scheme used in an image forming apparatus using an electrophotographic scheme, foreign substances, such as residual toner remaining after transfer and external additives, which have adhered to a photosensitive member adhere to a charging member, and image defects may be generated due to unevenness in charging.

A configuration is known which uses multiple charging rollers and in which a time period for which evenness in charging is maintained is prolonged in the following manner. A charging roller disposed on the downstream side is also charged so that the unevenness in charging which occurs due to the attachment of foreign substances onto a charging roller disposed on the upstream side in the rotation direction of a photosensitive member is corrected. In this case, there remains a problem in that foreign substances adhere to the charging roller disposed on the downstream side in the rotation direction of the photosensitive member when the accumulated number of image-formed sheets is increased, and in that image defects are generated due to the unevenness in charging.

PTL 1 describes that a cleaning mode is provided in which, in the case where multiple charging rollers are provided, deposits adhering to a charging roller on the downstream side in the rotation direction of the photosensitive member are removed by using a potential difference between a charge potential of a photosensitive member which is formed by using a charging roller on the upstream side and a direct voltage applied to the charging roller on the downstream side, when a non-image portion is formed.

However, in a method, as described in PTL 1, in which a charging roller is cleaned when a non-image portion is formed, cleaning needs to be performed by providing downtime during continuous image forming operations, resulting in a problem of reducing productivity of the image forming apparatus.

CITATION LIST

Patent Literature

PTL 1 Japanese Patent Laid-Open No. 09-080874

SUMMARY OF INVENTION

Therefore, an object of the present invention is to provide an image forming apparatus which has multiple charging rollers and which suppresses accumulation of deposits such as external additives onto a charging roller without reducing productivity of the image forming apparatus.

The present invention provides an image forming apparatus including a rotatable photosensitive member, a first charging roller for charging the photosensitive member, a second charging roller for charging the photosensitive member on the downstream side of the first charging roller in a rotation direction of the photosensitive member, a toner image forming unit disposed on the downstream side of the second charging roller in the rotation direction of the photosensitive member, a first power supply, a second power supply, and control means. The toner image forming unit forms a latent image on a surface of the photosensitive member which has been charged by using the first charging roller and the second charging roller, and develops the latent image by using toner so as to form a toner image. The first power supply applies a changing voltage to the first charging roller. The voltage value of the changing voltage is made to change. The second power supply applies a voltage obtained by superimposing an alternating voltage on a direct voltage, to the second charging roller. The control means changes the changing voltage applied from the first power supply to the first charging roller in such a manner that a magnitude relationship between a potential of the photosensitive member which has been charged by using the first charging roller and which has reached a position at which the photosensitive member is charged by using the second charging roller, and the direct voltage applied to the second charging roller is alternately switched, when the photosensitive member is to be charged by using the first charging roller and the second charging roller to form a toner image. When the photosensitive member is to be charged by using the first charging roller and the second charging roller to form a toner image, the following relations are satisfied, $$X>(W/PS), Y>(W/PS),$$

where X (s) represents a time period for which the potential of the surface of the photosensitive member which has been charged by using the first charging roller and which has reached a position at which the photosensitive member is charged by using the second charging roller is less than the direct voltage applied to the second charging roller, Y (s) represents a time period for which the potential is more than the direct voltage, PS (mm/s) represents a peripheral velocity of the photosensitive member, and W (mm) represents the width of a contact portion between the second charging roller and the photosensitive member in the rotation direction of the photosensitive member. The sum of X and Y is larger than a period of the alternating voltage applied to the second charging roller.

Further features of the present invention will become apparent from the following description of exemplary embodiments with reference to the attached drawings.

DESCRIPTION OF EMBODIMENTS

Figure 1:
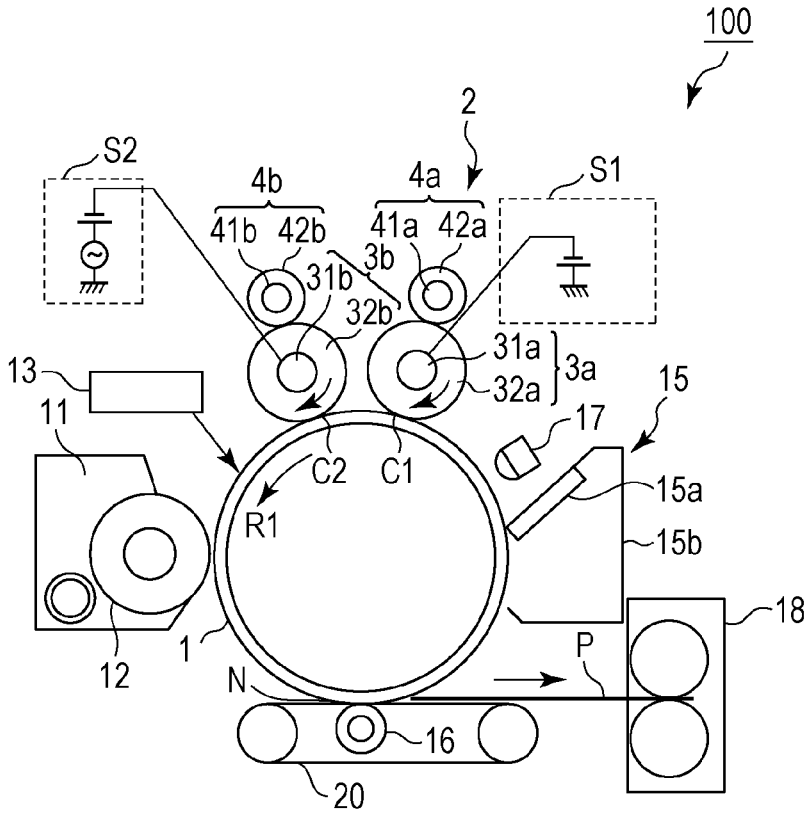
FIG. 1 is a schematic sectional view of a principal part of an image forming apparatus according to one embodiment of the present invention.

An image forming apparatus according to the present invention will be described in more detail below referring to the drawings.

First Embodiment

1. Overall Configuration and Operations of Image Forming Apparatus

Figure 2:
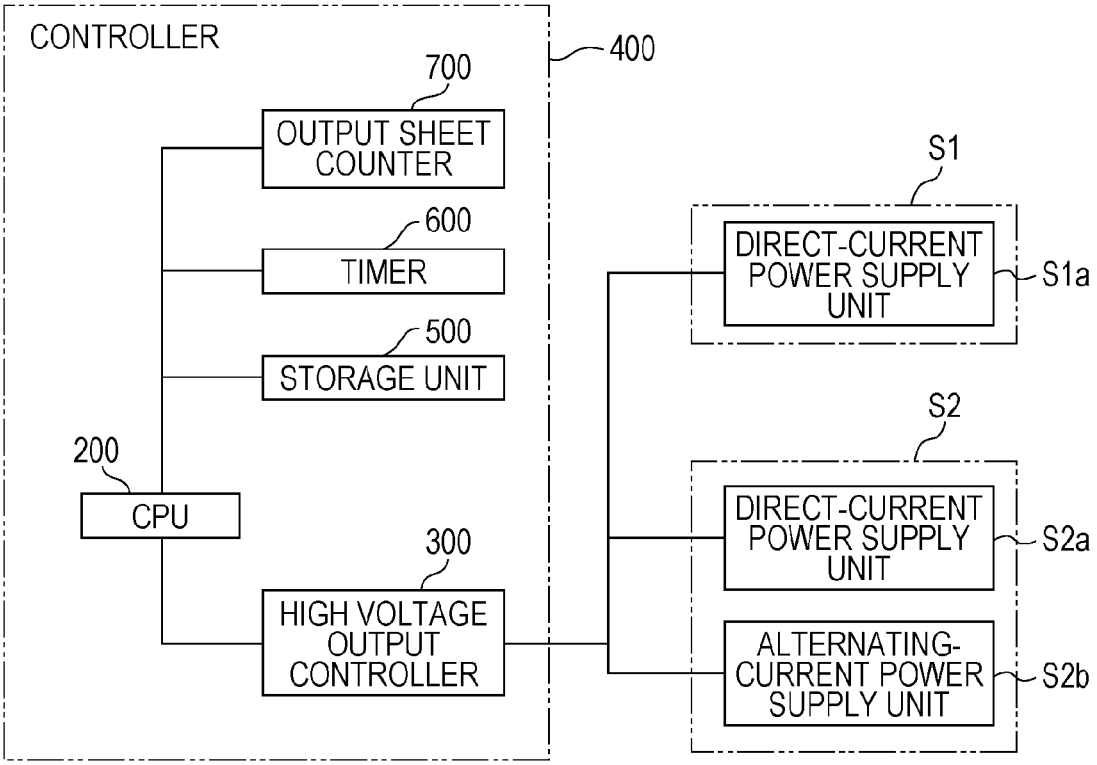
FIG. 2 is a block diagram illustrating a general control aspect of a principal part of an image forming apparatus according to one embodiment of the present invention.

FIG. 1 is a schematic sectional view illustrating the configuration of a principal part of an image forming apparatus 100 according to an embodiment of the present invention. FIG. 2 is a block diagram illustrating a control aspect of the principal part of the image forming apparatus 100 in the present embodiment. In the present embodiment, the image forming apparatus 100 is a printer using an electrophotographic scheme.

The image forming apparatus 100 includes a cylindrical electrophotographic photosensitive member (photosensitive member) 1 which serves as an image bearing member. The photosensitive member 1 is rotatably supported so as to be rotated in the direction indicated by an arrow R1 in FIG. 1 (counterclockwise) by a drive motor (not illustrated) which serves as drive means.

Around the photosensitive member 1, the following sequence of means is disposed from the upstream side in the rotation direction of the photosensitive member 1: a first charging roller 3*a* which is a roller-shaped first charging member serving as first charging means; a second charging roller 3*b* which is a roller-shaped second charging member serving as second charging means; an exposure apparatus (laser scanner) 13 which serves as exposure means (image writing means); a developing apparatus 11 which serves as developing means; a transfer belt 20 which serves as a recording-member bearing member (conveying means); a cleaning apparatus 15 which serves as cleaning means; and a before-charging exposure lamp 17 which is optical discharging means serving as discharging means. The first and second charging rollers 3*a* and 3*b* constitute a charging apparatus 2.

A transfer roller 16 which is a roller-shaped transfer member serving as transfer means is disposed on the inner periphery side of the transfer belt 20. The transfer roller 16 is pressed against the photosensitive member 1 with the transfer belt 20 interposed therebetween, which forms a transfer portion N in which the photosensitive member 1 is in contact with the transfer belt 20.

In addition, the image forming apparatus 100 includes a feeding mechanism (not illustrated) for conveying a recording member (recording medium) P such as recording paper to the transfer portion N, and a fixing apparatus 18 which serves as fixing means disposed on the downstream side of the transfer portion N in the conveying direction of the recording member P.

When an image is to be formed, the surface of the photosensitive member 1 is charged at a predetermined potential of a predetermined polarity (in the present embodiment, negative polarity) by using the first charging roller 3*a* and the second charging roller 3*b*. The charge voltage (charge bias) applied to the first and second charging rollers 3*a* and 3*b* at that time will be described in detail below.

The charged surface of the photosensitive member 1 is exposed in accordance with image information by the exposure apparatus 13 constituting a toner image forming unit. Thus, an electrostatic latent image (electrostatic image) is formed on the photosensitive member 1.

The electrostatic latent image formed on the photosensitive member 1 is supplied with toner which serves as a developer by the developing apparatus 11 constituting a toner image forming unit so as to be developed (visualized). The developing apparatus 11 has a development sleeve 12 which serves as a developer bearing member, and toner which is borne on the development sleeve 12 and which is conveyed to a unit opposite the photosensitive member 1 (development unit) is transferred onto the photosensitive member 1 in accordance with the electrostatic latent image on the photosensitive member 1. When development is to be performed, a predetermined developing voltage (developing bias) is applied to the development sleeve 12. In the present embodiment, a toner image is formed by combining the image area exposure and the reversal developing. That is, toner charged to the same polarity as the charge polarity of the photosensitive member 1 (in the present embodiment, negative polarity) adheres to an exposed portion on the photosensitive member 1 in which the absolute value of the potential is decreased by performing exposure after a charging process. In the present embodiment, the intended charge polarity (normal charge polarity) of toner with which an electrostatic latent image on the photosensitive member 1 is developed is negative polarity.

The toner image formed on the photosensitive member 1 is conveyed to the transfer portion N. At that timing, the transfer belt 20 conveys the recording member P to the transfer portion N. The transfer roller 16 operates so that the toner image is transferred from the photosensitive member 1 onto the recording member P supported on the transfer belt 20. At that time, a transfer voltage (transfer bias) which is a direct voltage having the reverse polarity of the normal charge polarity of toner (in the present embodiment, positive polarity) is applied to the transfer roller 16.

The recording member P on which the toner image is transferred is separated from the transfer belt 20, and is conveyed to the fixing apparatus 18. The fixing apparatus 18 uses heat and pressure to fix the toner image onto the recording member P. After that, the recording member P is ejected to the outside of the image forming apparatus 100.

Toner which remains on the surface of the photosensitive member 1 after the transfer process (after-transfer residual toner) is cleaned by the cleaning apparatus 15. The cleaning apparatus 15 uses a cleaning blade 15*a* which serves as a cleaning member to remove the after-transfer residual toner from the surface of the rotating photosensitive member 1, and the residual toner is recovered in a waste-toner container 15*b*.

The photosensitive member 1 is irradiated with light by using the before-charging exposure lamp 17, whereby the residual charge is removed, and the photosensitive member 1 is then charged by using the first and second charging rollers 3*a* and 3*b*.

2. Photosensitive Member

In the present embodiment, the photosensitive member 1 is a rotatable drum-shaped electrophotographic photosensitive member, that is, a photosensitive member drum. In the present embodiment, the photosensitive member 1 is a negatively charged amorphous silicon photosensitive member which has an outside diameter of 84 mm and a length (in the rotation axis direction) of 381 mm, and is rotated in the direction indicated by the arrow R1 in FIG. 1 (counterclockwise) at a peripheral velocity of 850 mm/sec. The photosensitive member 1 has a photosensitive member layer on the surface of an aluminum cylinder (conductive body). In the present embodiment, the film thickness of the photosensitive member layer is about 30 μm. An organic photoconductor (OPC) or the like may be used as the photosensitive member 1.

3. Charging Apparatus

In the present embodiment, the charging apparatus 2 for evenly charging the surface of the photosensitive member 1 has the first and second charging rollers 3*a* and 3*b* which are two roller-shaped charging members serving as charging members. In the rotation direction of the photosensitive member 1, the first charging roller 3*a* is disposed on the upstream side, and the second charging roller 3*b* is disposed on the downstream side. Each of the first and second charging rollers 3*a* and 3*b* is in contact with the photosensitive member 1. The first and second charging rollers 3*a* and 3*b* are pressed against the surface of the photosensitive member 1 by using pressing springs which serve as pressure means, at the end portions in the longitudinal direction (rotation axis direction) thereof. The first and second charging rollers 3*a* and 3*b* are driven and rotated in accordance with the rotation of the photosensitive member 1. The rotation axis directions of the first and second charging rollers 3*a* and 3*b* are substantially parallel to the rotation axis direction of the photosensitive member 1.

The rotation directions of the first and second charging rollers 3*a* and 3*b* are not limited to the direction in which the photosensitive member 1 and the first and second charging rollers 3*a* and 3*b* move forward in the portion in which the photosensitive member 1 and the first and second charging rollers 3*a* and 3*b* are opposite each other. For example, the first and second charging rollers 3*a* and 3*b* may be in non-contact with the photosensitive member 1, and the first and second charging rollers 3*a* and 3*b* may be rotated in the direction opposite to the moving direction of the photosensitive member 1 in the portion in which the photosensitive member 1 and the first and second charging rollers 3*a* and 3*b* are opposite each other.

In the present embodiment, the first and second charging rollers 3*a* and 3*b* have substantially the same configuration. The first and second charging rollers 3*a* and 3*b* have elastic layers 32*a* and 32*b* composed of a semiconductive elastic rubber on the surfaces of core metal portions 31*a* and 31*b*, respectively, which serve as core members. The outside diameter of the first and second charging rollers 3*a* and 3*b* is ϕ14 mm, and the diameter of the core metal portions 31*a* and 31*b* is ϕ8 mm. The volume resistivity of the semiconductive elastic rubber of which the elastic layers 32*a* and 32*b* are formed ranges from $10^4$ to $10^7$ Ω·cm.

In the present embodiment, the charging apparatus 2 has first and second cleaning rollers 4*a* and 4*b* serving as cleaning members which clean the first and second charging rollers 3*a* and 3*b*, respectively. In the present embodiment, the first and second cleaning rollers 4*a* and 4*b* have substantially the same configuration. The first and second cleaning rollers 4*a* and 4*b* have elastic layers 42*a* and 42*b* formed of foamed sponge on core metal portions 41*a* and 41*b* which serve as core members, respectively. The first and second cleaning rollers 4*a* and 4*b* are pressed against the surfaces of the first and second charging rollers 3*a* and 3*b* by using pressing springs which serve as pressure means. The first and second cleaning rollers 4*a* and 4*a* are driven and rotated in accordance with the rotation of the first and second charging rollers 3*a* and 3*b*, respectively. The first and second cleaning rollers 4*a* and 4*b* cause removal of deposits, such as toner and external additives, which adhere onto the surfaces of the first and second charging rollers 3*a* and 3*b*, respectively. The first and second cleaning rollers 4*a* and 4*b* cause some of deposits, such as toner and external additives, which have been removed from the surfaces of the first and second charging rollers 3*a* and 3*b* to physically adhere to and be captured by the foamed members of the first and second cleaning rollers 4*a* and 4*b*. The other deposits are temporarily in contact with the foamed sponges of the first and second cleaning rollers 4*a* and 4*b*, and are then swept by using contact portions (nip portions) between the first and second charging rollers 3*a* and 3*b* and the first and second cleaning rollers 4*a* and 4*b*. Then, the deposits are moved back to the surface side of the first and second charging rollers 3*a* and 3*b*. The present invention may be embodied by using a configuration without the first and second cleaning rollers 4*a* and 4*b* being disposed. However, by rotating the first and second cleaning rollers 4*a* and 4*b* and the first and second charging rollers 3*a* and 3*b* which are in contact with each other, an effect of dispersing deposits on the surfaces of the first and second charging rollers 3*a* and 3*b* and an effect of reducing adhesion of the deposits can be achieved.

Operations will be generally described in which deposits on the first and second charging rollers 3*a* and 3*b* come in contact with the first and second cleaning rollers 4*a* and 4*b* and then adhere again to the surfaces of the first and second charging rollers 3*a* and 3*b*, and in which the deposits are then removed.

Deposits adhering to the surfaces of the first and second charging rollers 3*a* and 3*b* again are conveyed to the contact portions between the photosensitive member 1 and the first and second charging rollers 3*a* and 3*b*, and are charged again through discharge produced when the first and second charging rollers 3*a* and 3*b* cause the photosensitive member 1 to be charged so that a potential is formed. In accordance with the direction of a current which flows upon charging of the photosensitive member 1, deposits having a charge polarity which have not moved to the photosensitive member 1 side are moved back again to the contact portions between the first and second cleaning rollers 4*a* and 4*b* and the first and second charging rollers 3*a* and 3*b*. Deposits which have moved from the surfaces of the first and second charging rollers 3*a* and 3*b* to the photosensitive member 1 side are recovered by using the developing apparatus 11 and the cleaning apparatus 15.

The behavior of the deposits which are charged again and which have moved back to the photosensitive member 1 will be further described. When the developing apparatus 11 forms a toner image, the deposits which are charged to the negative polarity and which have moved back to the photosensitive member 1 are categorized into those in the non-image portion and those in the image portion. The deposits in the non-image portion on the photosensitive member 1 are recovered by the developing apparatus 11 due to an action of non-image-portion potential difference (non-image-portion contrast potential difference) which functions between the developing apparatus 11 and the photosensitive member 1. The deposits in the image portion on the photosensitive member 1 is synthesized into a toner image formed by the developing apparatus 11 due to the image-portion potential difference (developing contrast potential difference) which functions between the developing apparatus 11 and the photosensitive member 1, and are conveyed to the transfer portion N so as to be transferred to the recording member P. Deposits which have not been transferred to the recording member P are conveyed to the cleaning apparatus 15 in a state in which the deposits adhere to the photosensitive member 1, and are cleaned.

In the present embodiment, high-pressure conditions applied to the first and second charging rollers 3*a* and 3*b* are different from each other. Therefore, the operation performed when the deposits move from the surface of the first charging roller 3*a* to the photosensitive member 1 side is different from that from the second charging roller 3*b*. The high-pressure conditions applied to the first and second charging rollers 3*a* and 3*b* and the operations of removing deposits will be further described in detail below.

In the present embodiment, the foamed sponges which form the elastic layers 42*a* and 42*b* of the first and second cleaning rollers 4*a* and 4*b* are insulating urethane foam members. Therefore, they do not influence the operation of charging the photosensitive member 1 by using the first and second charging rollers 3*a* and 3*b*.

A first high-voltage power supply S1 which serves as a first power supply is connected to the core metal portion 31*a* of the first charging roller 3*a*. The first high-voltage power supply S1 includes a direct-current power supply unit S1*a*. The first high-voltage power supply S1 can apply a direct voltage to the first charging roller 3*a* and can change the voltage.

In the present embodiment, the direct voltage applicable to the first charging roller 3*a* ranges from −200 V to −2000 V.

A second high-voltage power supply S2 which serves as a second power supply is connected to the core metal portion 31*b* of the second charging roller 3*b*. The second high-voltage power supply S2 includes a direct-current power supply unit S2*a* and an alternating-current power supply unit S2*b*, and can apply an oscillating voltage obtained by superimposing an alternating voltage on a direct voltage to the second charging roller 3*b*.

In the present embodiment, the direct voltage applicable to the second charging roller 3*b* ranges from −500 V to −1000 V. In the present embodiment, the alternating voltage applicable to the second charging roller 3*b* has a frequency of 5.86 KHz and a voltage between peaks Vpp which can be changed in a range from 0 V to 2000 V.

In the present embodiment, the first and second charging rollers 3*a* and 3*b* come in contact with the surface of the photosensitive member 1 which is a body to be charged, and voltages (charge voltages) are applied to the first and second charging rollers 3*a* and 3*b*. Thus, discharge produced in minute gaps between the first and second charging rollers 3*a* and 3*b* and the photosensitive member 1 causes the photosensitive member 1 to be charged. For each of the first and second charging rollers 3*a* and 3*b*, a corresponding one of the minute gaps is constituted by one or both of space portions having a wedge shape (shape viewed along the rotation axis of the photosensitive member 1) which are disposed on the upstream side and the downstream side in the rotation direction of the photosensitive member 1. Which one of the space portions disposed on the upstream side and the downstream side is mainly used to charge the photosensitive member 1 depends on various settings, such as the dimensions and the electrical resistivity of the photosensitive member 1 and the first and second charging rollers 3*a* and 3*b*. In the present embodiment, any settings may be employed.

In the above description, for the sake of convenience, a first charging position C1 at which the photosensitive member 1 is charged by using the first charging roller 3*a* and a second charging position C2 at which the photosensitive member 1 is charged by using the second charging roller 3*b* are typified by the following positions. That is, the first charging position C1 is located at the most downstream position of the contact portion between the first charging roller 3*a* and the photosensitive member 1, in the rotation direction of the photosensitive member 1. The surface of the photosensitive member 1 just after passing through the first charging position C1 has been charged by using the first charging roller 3*a*. The second charging position C2 is located at the most upstream position of the contact portion between the second charging roller 3*b* and the photosensitive member 1, in the rotation direction of the photosensitive member 1. When the surface of the photosensitive member 1 reaches the second charging position C2, the surface is charged by using the second charging roller 3*b*. Therefore, a direct current described below which flows between the second charging roller 3*b* and the photosensitive member 1 is regarded as a current which flows at the second charging position C2.

In the present invention, a precise position at which charging is performed or at which a current flows is not important. For each of the first and second charging rollers 3*a* and 3*b*, it is understood that charging is performed or a current flows approximately between the time point at which the surface reaches the minute gap located on the upstream side and the time point at which the surface has passed through the minute gap located on the downstream side. To put it most simply, even if it is assumed that charging is performed or a current flows at the center position of the contact portion between each of the first and second charging rollers 3*a* and 3*b* and the photosensitive member 1, in the rotation direction of the photosensitive member 1, no problems will arise in the understanding of the present invention.

4. Control Aspect

With reference to FIG. 2, in the present embodiment, a CPU 200 which serves as control means of a controller (control circuit) 400 provided for the image forming apparatus 100 controls the entire operations of the image forming apparatus 100.

A high voltage output controller 300, a storage unit 500 which stores, for example, control data for the charge voltages, a timer 600 which serves as time measuring means, an output sheet counter 700 which serves as counting means for counting the number of image output sheets, and the like are connected to the CPU 200. The first high-voltage power supply S1 and the second high-voltage power supply S2 are connected to the high voltage output controller 300.

The CPU 200 can perform processing on the basis of the data stored in the storage unit 500 or information from the timer 600 and the counter 700, and can transmit an instruction to the high voltage output controller 300. The CPU 200 controls a direct voltage which is output by the first high-voltage power supply S1 and a direct voltage and an alternating voltage which are output by the second high-voltage power supply S2, through the high voltage output controller 300. The high voltage output controller 300, for example, turns on/off output of the first high-voltage power supply S1 and the second high-voltage power supply S2, and detects and controls output values in accordance with an instruction from the CPU 200.

The first and second charging rollers 3*a* and 3*b*, the first and second cleaning rollers 4*a* and 4*b*, the first high-voltage power supply S1, the second high-voltage power supply S2, and the like constitute the charging apparatus 2.

5. Charging Operation 5-1. Charging Operation of First Charging Roller

A charging operation performed by using the first charging roller 3*a* will be described. A changing voltage whose value is changed is applied to the first charging roller 3*a*, causing the photosensitive member 1 to be charged.

Figure 3:
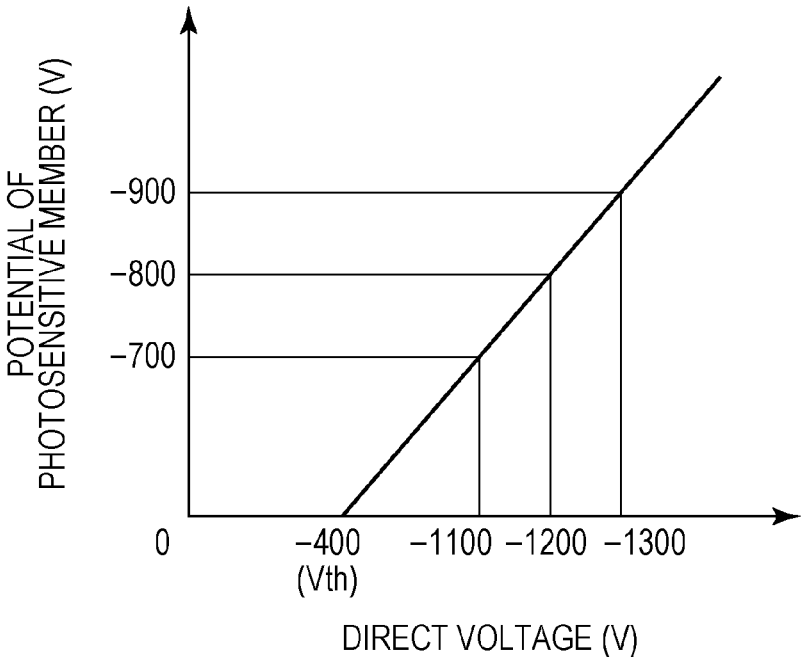
FIG. 3 is a graph for describing a charging operation performed by using a first charging roller in one embodiment of the present invention.

FIG. 3 illustrates the relationship between a direct voltage applied to the first charging roller 3*a* and the potential (surface potential) of the photosensitive member 1 after charging. As illustrated in FIG. 3, when a direct voltage which is applied from the first high-voltage power supply S1 to the first charging roller 3*a* becomes equal to or more than −400 V which is set to a discharge start voltage Vth, the photosensitive member 1 is charged. In the present embodiment, a direct voltage of −1200 V which is applied to the first charging roller 3*a* causes the photosensitive member 1 to be charged at a potential of −800 V. At that time, a current of −700 μA flows between the first charging roller 3*a* and the photosensitive member 1.

In the embodiments described herein, a current which flows in the direction from the first and second charging rollers 3*a* and 3*b* side to the photosensitive member 1 side is a "positive direction" current, and the value of such a current is a "positive" value.

Figure 4A:
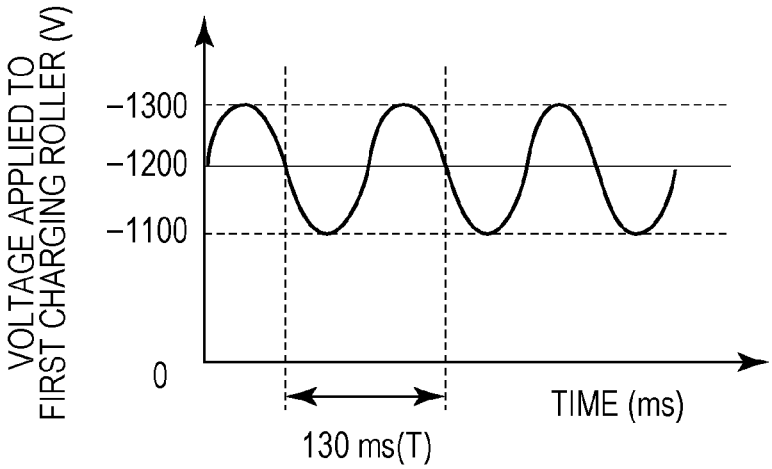
FIGS. 4A and 4B include graphs for describing a voltage applied to a first charging roller and a potential of a photosensitive member just after passing through a first charging position in one embodiment of the present invention.
Figure 4B:
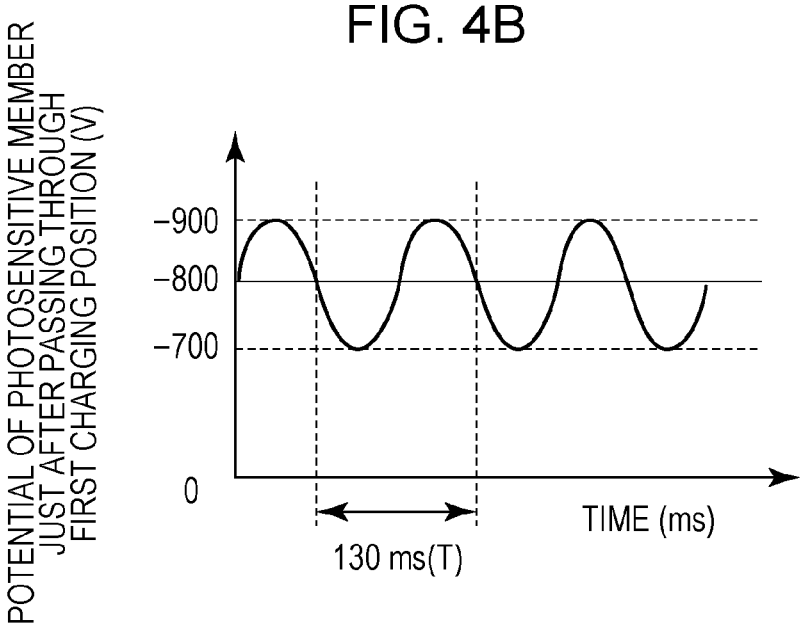

FIG. 4A illustrates a changing voltage applied to the first charging roller 3*a*. FIG. 4B illustrates the potential of the photosensitive member 1 just after passing through the first charging position C1 (after the photosensitive member 1 is charged by using the first charging roller 3*a*).

As illustrated in FIG. 4A, the changing voltage applied to the first charging roller 3*a* is represented by a function of time. In the present embodiment, the changing voltage applied to the first charging roller 3*a* when an image is to be formed is changed with a median of −1200 V and in a range of ±100 V. The waveform of the voltage is a sine wave having a period (T) of 130 ms.

The voltage as described above is applied to the first charging roller 3*a*, whereby a potential as illustrated in FIG. 4B is formed on the surface of the photosensitive member 1 just after passing through the first charging position C1. That is, as illustrated in FIG. 4B, the first charging roller 3*a* causes a potential (changing potential) whose median is −800 V, whose range of change is ±100 V, whose maximum on the charge polarity side of the photosensitive member 1 is −900 V, whose minimum is −700 V, and whose period (T) is 130 ms to be formed on the surface of the photosensitive member 1. Thus, the first charging roller 3*a* causes formation of a charge potential which changes in a wave form in the circumferential direction of the photosensitive member 1.

Figure 5:
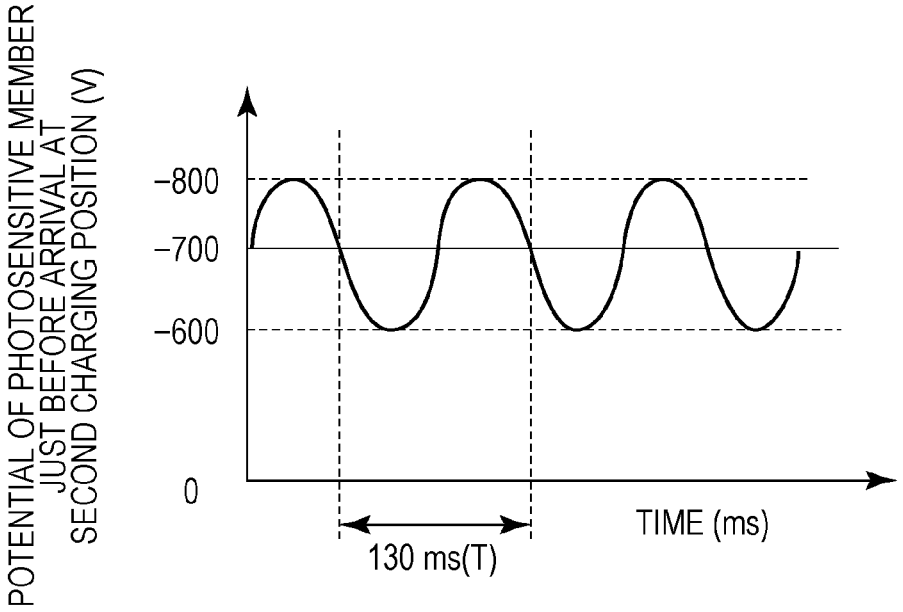
FIG. 5 is a graph for describing a potential of a photosensitive member just before arrival at a second charging position according to one embodiment of the present invention.

FIG. 5 illustrates the potential of the photosensitive member 1 just before arrival at the second charging position C2 (before the photosensitive member 1 is charged by using the second charging roller 3*b*). In the present embodiment, the dark decay of the charge potential of the photosensitive member 1 causes the potential to decrease by about 100 V between the first charging position C1 and the second charging position C2. Therefore, a potential (changing potential) whose median is −700 V, whose range of change is ±100 V, whose maximum on the charge polarity side of the photosensitive member 1 is −800 V, and whose minimum is −600 V is formed on the surface of the photosensitive member 1 just before arrival at the second charging position C2.

In the present embodiment, during image formation, the potential of the photosensitive member 1 which is formed by using the first charging roller 3*a* is used to cause a current to flow alternately in the positive and negative directions through discharge to the second charging roller 3*b*, whereby deposits (contaminants), such as toner and external additives, which adhere to the surface of the second charging roller 3*b* are reduced. More specifically, the above-described discharge current alternately flows mainly in a discharge gap that is a minute space in which discharge occurs and which is located upstream of the contact portion between the second charging roller 3*b* and the photosensitive member 1 in the rotation direction of the photosensitive member.

Accordingly, the difference between the potential (PreVD) of the photosensitive member 1 just before arrival at the second charging position C2 and the potential (Vdc) of the direct voltage applied to the second charging roller 3*b* (=PreVD−Vdc) is switched between a negative side value and a positive side value.

The relationship between the potential of the photosensitive member 1 which is formed by using the first charging roller 3*a* and a current which flows to the second charging roller 3*b* will be further described below.

The time period for which the difference between the potential of the photosensitive member 1 just before arrival at the second charging position C2 and the potential of the direct voltage applied to the second charging roller 3*b* is a negative side value is represented by X (s), and the time period for which the difference is a positive side value is represented by Y (s). That is, a time period for which the potential of the surface of the photosensitive member 1 which has been charged by using the first charging roller 3*a* and which has reached the position at which the surface is to be charged by using the second charging roller 3*b* is smaller than the direct voltage applied to the second charging roller 3*b* is represented by X (s), and a time period for which the potential of the surface of the photosensitive member 1 is larger than the direct voltage is represented by Y (s). In the present embodiment, both of X and Y are 65 ms, and are equal to each other.

To remove deposits on the second charging roller 3*b*, the change in the potential of the photosensitive member 1 (changing potential) which is formed by using the first charging roller 3*a* is preferably set in consideration of the following two conditions.

First Condition

To remove deposits on the second charging roller 3*b*, the direction (the positive direction or the negative direction) of a current which flows to the second charging roller 3*b* is set so as not to be switched in the time period in which the surface of the photosensitive member passes through at least the gap located upstream of the second charging roller 3*b* and in the vicinity of the contact portion between the second charging roller 3*b* and the photosensitive member 1. As described above, it can be assumed that charging is performed and a current flows in the contact portion between the second charging roller 3*b* and the photosensitive member 1 which is located in the rotation direction of the photosensitive member 1. Therefore, to remove deposits on the second charging roller 3*b*, the direction (the positive direction or the negative direction) of a current which flows to the second charging roller 3*b* is set so as not to be switched in the time period in which the second charging roller 3*b* comes in contact with the photosensitive member 1. To achieve this, "X" and "Y" are set to be longer than the time period in which the second charging roller 3*b* comes in contact with the photosensitive member 1. Therefore, it is preferable to provide settings so that the following relations are satisfied, where the width of the contact portion between the second charging roller 3*b* and the photosensitive member 1 in the rotation direction of the photosensitive member 1 is represented by W (mm), and the peripheral velocity of the photosensitive member 1 is represented by PS (mm/s).

$$X>(W/PS), Y>(W/PS)$$

For example, in the present embodiment, the width W of the contact portion between the second charging roller 3*b* and the photosensitive member 1 is 2 (mm), and the peripheral velocity PS of the photosensitive member 1 is 850 mm/sec. Therefore, W/PS=2.35 msec.

The "sum of X and Y" is set to be larger than the period of the alternating voltage applied to the second charging roller 3*b*. Thus, as described in detail below, the potential difference between the potential of the surface of the photosensitive member 1 which has been charged by using the first charging roller 3*a* and which has reached the second charging position C2 and the direct voltage applied to the second charging roller 3*b* causes deposits on the second charging roller 3*b* to be removed. For example, in the present embodiment, the sum of X and Y is equal to 130 ms (=65 ms+65 ms), and the period of the alternating voltage applied to the second charging roller 3*b* is about 0.171 ms (=1/5.86 KHz).

Second Condition

Just before arrival at the second charging position C2, the changing potential of the photosensitive member 1 which is formed by using the first charging roller 3*a* is preferably set so that each of "X", "Y", and the "sum of X and Y" is a non-integer multiple of the rotation period of the second charging roller 3*b*. The reason why each of "X" and "Y" is set to be a non-integer multiple of the rotation period of the second charging roller 3*b* is that the potential difference between the direct voltage applied to the second charging roller 3*b* and a different potential of the photosensitive member 1 which has reached the second charging position C2 is to correspond to each rotation of the second charging roller 3*b*. The reason why the "sum of X and Y" is set to be a non-integer multiple of the rotation period of the second charging roller 3*b* is that points at which the direction (the positive direction or the negative direction) of a current which flows to the second charging roller 3*b* is switched, that is, points at which no current flows, are to be shifted from the rotation period of the second charging roller 3*b*.

To evenly remove both of deposits with positive polarity and those with negative polarity which adhere onto the second charging roller 3*b*, it is preferable that X≈Y.

The settings thus provided enable a current to flow to the second charging roller 3*b* in such a manner that switching is performed between a current in the positive direction and one in the negative direction in a balanced manner, and enable deposits on the second charging roller 3*b* to be evenly removed.

In the present embodiment, both of X and Y are set to 65 ms, which is 1.25 times the rotation period of the second charging roller 3*b*. The sum of X and Y is set to be 2.5 times the rotation period of the second charging roller 3*b*.

It is preferable that the sum of X and Y be shorter than the time period in which a surface region of the photosensitive member 1 on which a toner image corresponding to one recording member is to be formed passes through the second charging roller 3*b*. This is because, even when one sheet of image is to be formed, deposits on the second charging roller 3*b* can be evenly removed. For example, in the present embodiment, when a toner image in which the longitudinal direction of an A4 size recording member corresponds to the rotation direction of the photosensitive member is to be formed, the time period in which the surface region of the photosensitive member passes through the second charging roller 3*b* is equal to about 247 ms because PS is 850 mm/sec and the length of the A4 size in the transverse direction is 210 mm.

In the image forming apparatus 100, multiple sizes of recording members P can be used. Therefore, the sum of X and Y may be set to be shorter than a time period in which the surface region of the photosensitive member on which a toner image corresponding to a recording member P of the minimum size used in the image forming apparatus 100 is to be formed passes through the second charging roller 3*b*.

In the present embodiment, a sine wave is used as the form of the voltage applied to the first charging roller 3*a*. However, a triangular voltage may be used.

5-2. Charging Operation of Second Charging Roller

The charging operation performed by using the second charging roller 3*b* will be described. An oscillating voltage obtained by superimposing an alternating voltage on a direct voltage is applied to the second charging roller 3*b*, whereby the photosensitive member 1 is charged.

Figure 6:
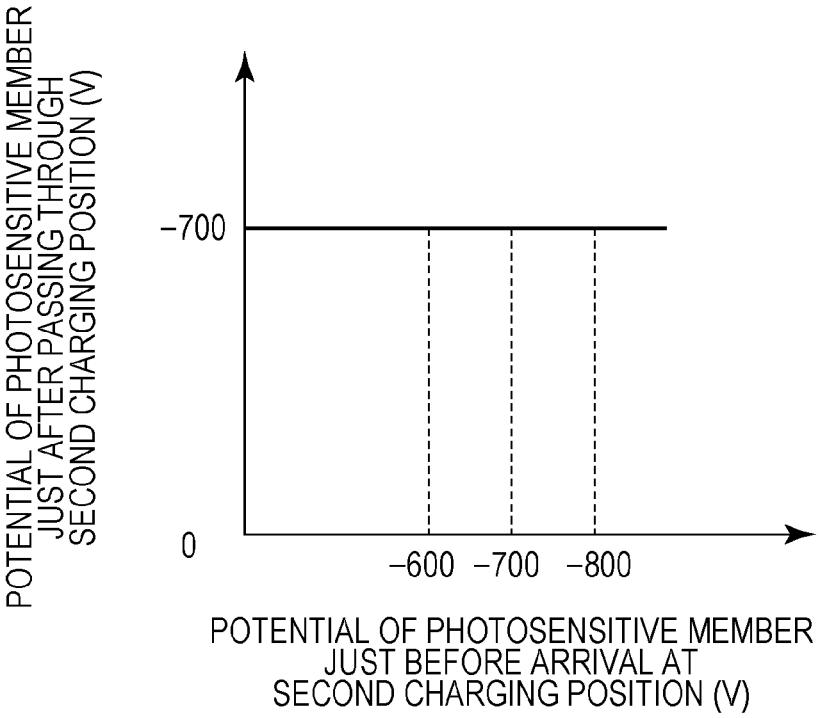
FIG. 6 is a graph for describing a potential of a photosensitive member just after passing through a second charging position in one embodiment of the present invention.

FIG. 6 illustrates the relationship between the potential of the photosensitive member 1 just before arrival at the second charging position C2 and the potential of the photosensitive member 1 just after passing through the second charging position C2 (after the photosensitive member 1 is charged by using the second charging roller 3*b*).

The alternating voltage applied to the second charging roller 3*b* when an image is to be formed has a voltage between peaks Vpp of 1200 V and a frequency of 5.86 KHz. The direct voltage applied to the second charging roller 3*b* when an image is to be formed is −700 V. The direct voltage is the same potential as the median of the potential of the photosensitive member 1 just before arrival at the second charging position C2.

At that time, the difference between the potential (PreVD) of the photosensitive member 1 just before arrival at the second charging position C2 and the potential (Vdc) of the direct voltage applied to the second charging roller 3*b* (=PreVD−Vdc) is switched between a negative side value and a positive side value, alternately. The negative side maximum and the positive side maximum of the difference between the potential of the photosensitive member 1 just before arrival at the second charging position C2 and the potential of the direct voltage applied to the second charging roller 3*b* are as follows.

Negative side maximum: (−800)−(−700)=−100 (V)

Positive side maximum: (−600)−(−700)=+100 (V)

As illustrated in FIG. 6, regardless of the potential of the photosensitive member 1 just before arrival at the second charging position C2, the potential (VD) of the photosensitive member 1 just after passing through the second charging position C2 is −700 V.

5-3. Current Flowing to Second Charging Roller

A current which flows to the second charging roller 3*b* will be described.

Figure 7A:
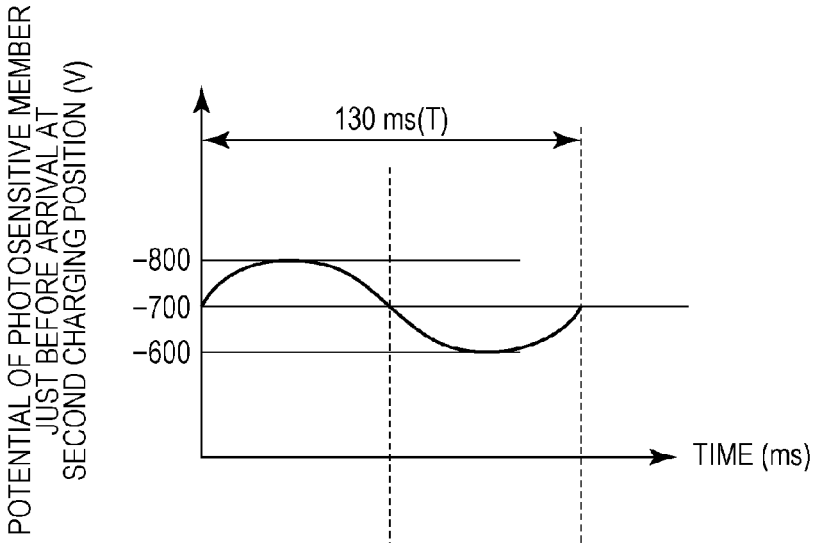
FIGS. 7A and 7B include graphs for describing a current flowing to a second charging roller in one embodiment of the present invention.
Figure 7B:
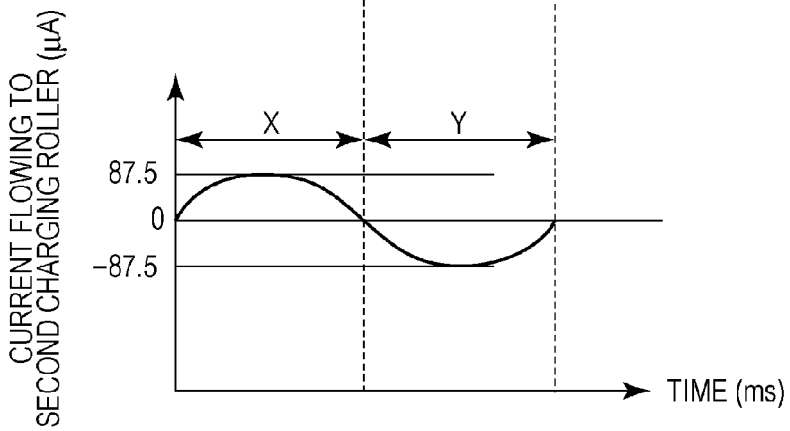

FIG. 7A illustrates the potential of the photosensitive member 1 just before arrival at the second charging position C2. FIG. 7B illustrates a current which flows to the second charging roller 3*b*. In addition, X and Y in FIG. 7B represent the respective above-described time periods. That is, X represents a time period for which the difference between the potential (PreVD) of the photosensitive member 1 just before arrival at the second charging position C2 and the potential (Vdc) of the direct voltage applied to the second charging roller 3*b* (=PreVD−Vdc) is a negative side value, and Y represents a time period for which the difference is a positive side value.

As illustrated in FIG. 7B, the direction of the current which flows between the second charging roller 3*b* and the photosensitive member 1 in an X period is opposite to that in a Y period. The period (T) of change in the current which flows to the second charging roller 3*b* is 130 ms. This period (T) is the same as the period (T) of the changing voltage applied to the first charging roller 3*a* and the period (T) of the photosensitive member 1 just before arrival at the second charging position C2.

In the present embodiment, the maximum of the current which flows to the second charging roller 3*b* in the positive direction in an X period is 87.5 μA, and the maximum of the current which flows in the negative direction in a Y period is −87.5 μA.

5-4. Operation of Reducing Deposits on Second Charging Roller

The operation of reducing deposits on the second charging roller 3*b* will be further described in detail.

Figure 8A:
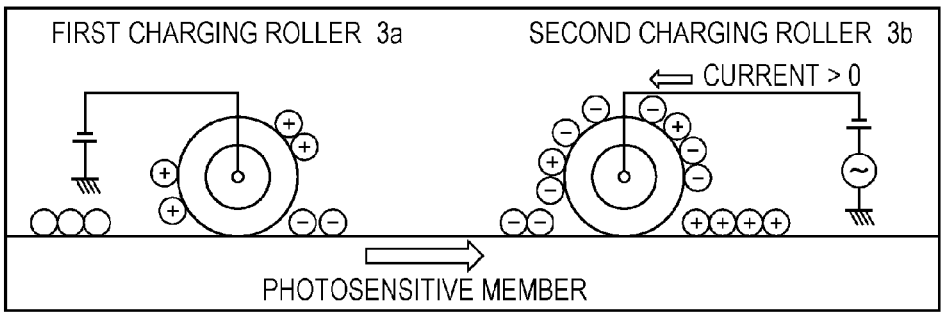
FIGS. 8A and 8B include schematic diagrams for describing relationship between charging polarities of deposits on a second charging roller and the direction of a current in one embodiment of the present invention.
Figure 8B:
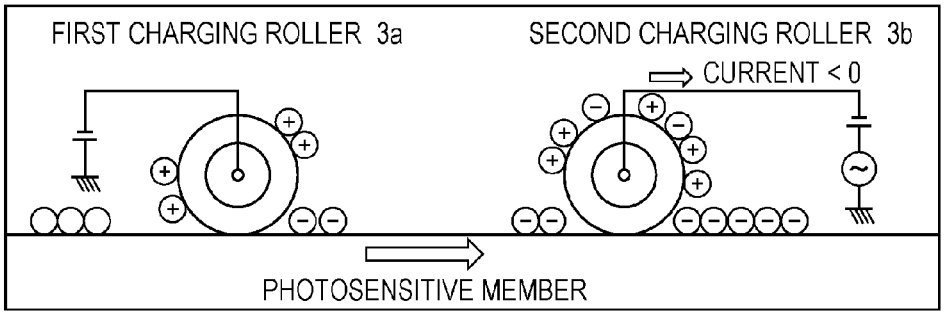

FIGS. 8A and 8B illustrate the relationship between the direction of a current which flows to the second charging roller 3*b* and charge polarities of deposits, such as toner and external additives, which adhere to the surface of the second charging roller 3*b*. FIG. 8A illustrates a case where a current flows between the second charging roller 3*b* and the photosensitive member 1 in the positive direction. That is, FIG. 8A illustrates a state in an X period in FIG. 7B. FIG. 8B illustrates a case where a current flows between the second charging roller 3*b* and the photosensitive member 1 in the negative direction. That is, FIG. 8B illustrates a state in a Y period in FIG. 7B.

In the present embodiment, a current which flows to the second charging roller 3*b* is switched per predetermined period (T=130 ms), and both of deposits charged to the positive polarity and deposits charged to the negative polarity on the second charging roller 3*b* are moved onto the photosensitive member 1 side depending on the direction of an current which flows to the second charging roller 3*a*.

Movement of Deposits in X Period

In FIG. 8A, a current flows from the second charging roller 3*b* side to the photosensitive member 1 side. That is, since a relatively higher potential on the positive polarity side is present on the second charging roller 3*b* side between the second charging roller 3*b* and the photosensitive member 1, a current flows from the second charging roller 3*b* side to the photosensitive member 1 side. Thus, deposits charged to the positive polarity on the photosensitive member 1 do not adhere to the second charging roller 3*b*, and pass through the second charging position C2. In contrast, deposits charged to the negative polarity on the photosensitive member 1 are recovered to the second charging roller 3*b*.

Movement of Deposits in Y Period

In FIG. 8B, a current flows from the photosensitive member 1 side to the second charging roller 3*b* side. That is, since a relatively higher potential on the positive polarity side is present on the photosensitive member 1 side between the second charging roller 3*b* and the photosensitive member 1, a current flows from the photosensitive member 1 side to the second charging roller 3*b* side. Thus, deposits charged to the negative polarity on the second charging roller 3*b* are moved back to the photosensitive member 1. In contrast, deposits charged to the positive polarity on the photosensitive member 1 adhere to the second charging roller 3*b*.

In the present embodiment, by repeating the operations in FIGS. 8A and 8B at the predetermined period (T) intervals, accumulation of deposits, such as toner and external additives, which are charged to the positive polarity or the negative polarity, onto the second charging roller 3*b* can be reduced. In addition, the charge polarity of deposits on the second charging roller 3*b* is not excessively biased toward the positive polarity or the negative polarity. Therefore, without a special cleaning mode in which an image cannot be formed, a long-term continuous image formation can be achieved. Consequently, downtime (time period during which an image cannot be output due to a cleaning operation or an adjustment operation) of the image forming apparatus 100 is reduced, and productivity can be improved.

Accumulation of deposits on the second charging roller 3*b* is reduced. Therefore, the amount of deposits moved from the second charging roller 3*b* to the photosensitive member 1 at a time is comparatively small. Therefore, deposits moved to the photosensitive member 1 do not inhibit image formation. As described above, many of the deposits which have been moved to the photosensitive member 1 are removed in a later stage in either of the following ways: recovery performed by the developing apparatus 11; transfer to the recording member P in the transfer portion N; and removal and recovery from the photosensitive member 1 which are performed by the cleaning apparatus 15 after passing through the transfer portion N.

During the operation as described above, the first and second cleaning rollers 4*a* and 4*b* are rotated in such a manner as to be in contact with the first and second charging rollers 3*a* and 3*b*, achieving an effect of dispersing deposits on the surfaces of the first and second charging rollers 3*a* and 3*b* as described above and an effect of reducing adhesion.

This will be further described. Many configurations of the related art which use multiple charging rollers focus on reduction in unevenness in charge potential. At the first charging roller located on the upstream side, a predetermined charge potential (PreVD) is formed on the photosensitive member. A voltage obtained by superimposing an alternating voltage on a direct voltage is applied to the second charging roller located on the downstream side, and charging is performed through discharge, whereby the capability of reducing unevenness in potential is increased. In particular, from this viewpoint, it is preferable to employ a condition that the potential (Vdc) of the direct voltage applied to the second charging roller equals to PreVD formed on the photosensitive member by using the first charging roller (PreVD=Vdc).

However, when the condition "PreVD=Vdc" is employed as described above, a direct current hardly flows to the second charging roller (Idc≈0 μA). Therefore, through alternating current discharge (in which both of discharge of the positive polarity and discharge of the negative polarity occur), both of particles charged to the positive polarity and particles charged to the negative polarity adhere to the second charging roller. Through alternating current discharge, both of particles charged to the positive polarity and particles charged to the negative polarity adhere onto the surface of the second charging roller. In addition, the polarities of deposits on the second charging roller are the positive polarity and the negative polarity. Therefore, when reverse bias is applied to clean the second charging roller, biases of both of the positive polarity and the negative polarity need to be applied. Consequently, when a cleaning sequence in which reverse bias is applied is performed, a long downtime is needed, and productivity may be reduced.

In the present embodiment, during image formation, a voltage applied to the first charging roller is changed periodically, and periodically changing PreVD of the photosensitive member is supplied to the second charging roller to which a predetermined direct voltage is applied. That is, the photosensitive member is charged through direct current discharge by using the first charging roller, and the direct voltage applied to the first charging roller is changed in a direct current discharge range. Thus, a discharge current on the surface of the second charging roller periodically alternates between positive and negative. As a result, during image formation, unevenness in the charge potential of the photosensitive member after charging is performed by using the second charging roller does not occur, and particles which are charged to the positive polarity and the negative polarity and which adhere onto the surface of the second charging roller can be moved to the photosensitive member side in the discharge direction. Therefore, deposits, such as toner and external additives, on the surface of the second charging roller can be decreased. That is, during image formation, toner and external additives which are charged to the positive polarity and the negative polarity do not stay on the second charging roller and are moved, enabling the amount of deposits to be reduced.

A voltage applied to the first charging roller is changed in accordance with a phase different from the rotation period of the second charging roller, whereby particles on the second charging roller which are charged to the positive polarity and the negative polarity can be evenly removed. That is, the period of PreVD formed on the photosensitive member by using the first charging roller is shifted from the rotation period of the second charging roller so that a region having the same potential PreVD does not come in contact with the same region of the second charging roller every time. For example, the rotation period of the second charging roller is represented by Ts. A variable period (T) of the changing voltage applied to the first charging roller is determined by using the relation, $T=2Ts/(2n-1)$, where n is an integer equal to or more than zero.

A discharge start voltage produced when a direct voltage is applied to a charging roller is represented by Vth. For the charge potential of the photosensitive member which has reached the second charging roller, the maximum on the charge polarity side of the photosensitive member is represented by VHI, and the minimum on the charge polarity side of the photosensitive member is represented by VLO. The potential of a direct voltage applied to the second charging roller is represented by Vdc. At that time, in the charging operation performed when an image is to be formed as described above, the relations, $|VHI-VLO|<2Vth$, $|VHI|>|Vdc|$, and $|VLO|<|Vdc|$, are to be satisfied. Thus, the charge potential of the photosensitive member after passing through the second charging position can statically converge on the potential of the direct voltage applied to the second charging roller.

Thus, the image forming apparatus 100 includes the rotatable photosensitive member 1, the first charging roller 3*a* which is in contact with or close to the photosensitive member 1, and the second charging roller 3*b* which is in contact with or close to the photosensitive member 1 and which is located on the downstream side of the first charging roller 3*a* in the rotation direction of the photosensitive member 1. In addition, the image forming apparatus 100 includes the first power supply S1 which applies a changing voltage whose voltage changes, to the first charging roller 3*a*, and the second power supply S2 which applies a voltage obtained by superimposing an alternating voltage on a direct voltage, to the second charging roller 3*b*. Further, the image forming apparatus 100 includes the control means 200 which changes the changing voltage applied from the first power supply S1 to the first charging roller 3*a* during image formation. The control means 200 changes the changing voltage applied to the first charging roller 3*a* as follows. That is, the magnitude relationship between the potential of the photosensitive member 1 which has been charged by using the first charging roller 3*a* and which has reached the position at which the photosensitive member 1 is charged by using the second charging roller 3*b* and the potential of the direct voltage applied to the second charging roller 3*b* are alternately switched. More specifically, during image formation, the control means 200 changes the changing voltage applied from the first power supply S1 to the first charging roller 3*a*, in a range of voltage which is larger than the discharge start voltage on the charge polarity side of the photosensitive member 1. In an embodiment, during image formation, the median of the changing voltage applied to the first charging roller 3*a* is substantially equal to the potential of the direct voltage applied to the second charging roller 3*b*.

In the present embodiment, a direct voltage source which can change a voltage is used as the first power supply S1 which applies the changing voltage to the first charging roller 3*a*, achieving cost reduction. The upper limit of change in the changing voltage in the case where a direct current source which outputs a voltage of a polarity of one side is used as the first power supply S1 as described in the present embodiment will be discussed. The discharge start voltage Vth which is the lower limit of the voltage with which the photosensitive member can be charged is substantially the lower limit of the changing voltage. In this case, to remove deposits on the second charging roller 3*b* evenly, it is preferable that a voltage which has the same potential difference as the potential difference between the median of the changing voltage and Vth which is the lower limit of the changing voltage described above be set to the upper limit of the maximum. In this case, the change $|VHI-VLO|$ in the charge potential of the photosensitive member which has reached the second charging roller satisfies the relation, $|VHI-VLO|<2\times|Vdc|$.

To achieve an effect of removing deposits, the lower limit of change in the changing voltage is preferably set to the potential of the photosensitive member which causes 10% or more of a current which flows when the photosensitive member is charged by using the first charging roller 3*a* so as to have a potential equal to the median of the changing potential, to flow between the second charging roller 3*b* and the photosensitive member. For example, when the photosensitive member is to be charged at −800 V by using the first charging roller 3*a*, the current which flows between the first charging roller 3*a* and the photosensitive member is −700 μA. In this case, when the resistance of the first charging roller 3*a* is equal to that of the second charging roller 3*b*, in order to flow a current of 70 μA or more between the second charging roller 3*b* and the photosensitive member, the change in the changing voltage is preferably set so that the potential difference between the potential of the photosensitive member and the direct voltage of the second charging roller 3*b* is 80 V or more.

6. Control Flow

Figure 9:
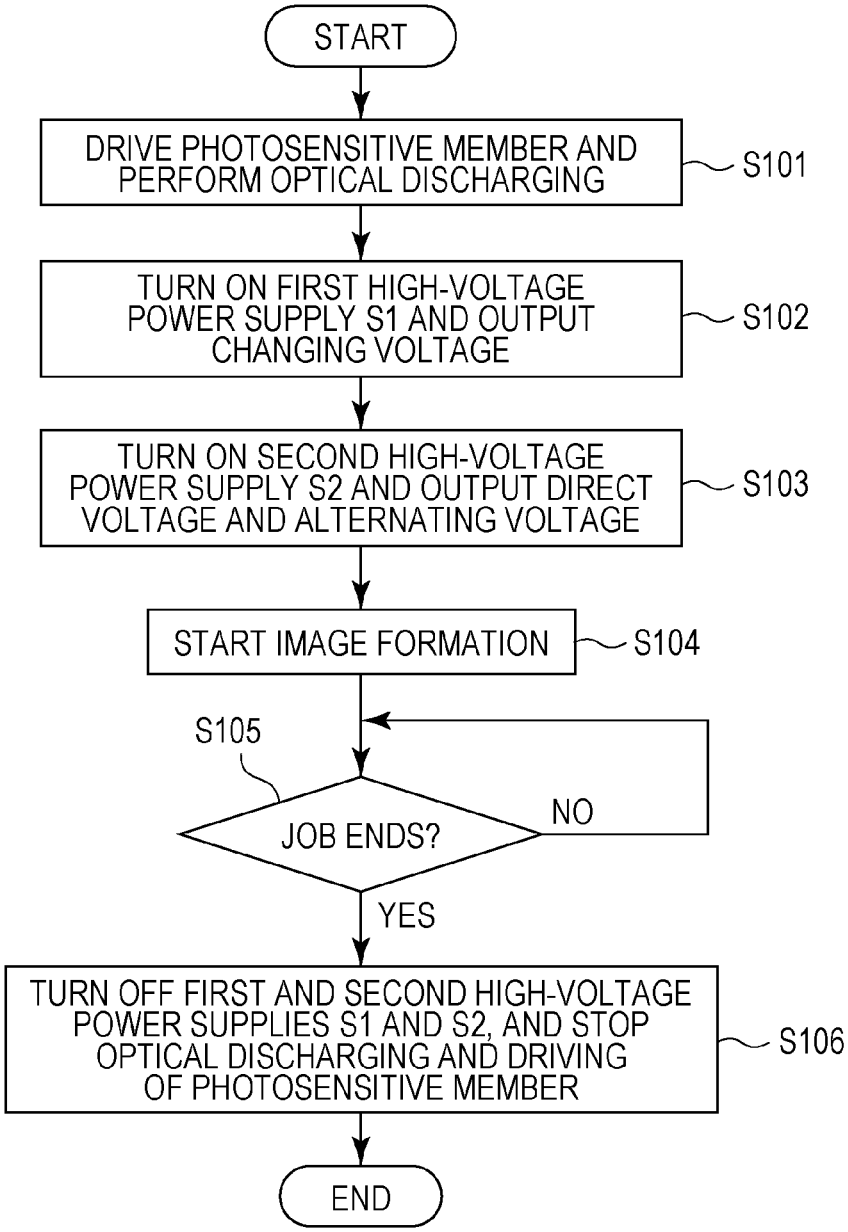
FIG. 9 is a flowchart of an image forming operation according to one embodiment of the present invention.

With reference to FIG. 9, the control flow performed when the image forming operation is performed in the present embodiment will be generally described. The CPU 200 controls the image forming apparatus 100 by using the following procedure when an image formation signal is input.

Receiving the image formation signal, the CPU 200 rotates the photosensitive member 1, and exposes the photosensitive member 1 to light by using the before-charging exposure lamp 17 (in step S101).

At the timing when steady rotation reached by the photosensitive member 1 is detected, the CPU 200 causes the first high-voltage power supply S1 to output a changing voltage (direct voltage) of the predetermined period (T) to the first charging roller 3*a* so that the photosensitive member 1 is charged (in step S102).

The CPU 200 causes the second high-voltage power supply S2 to output an oscillating voltage obtained by superimposing an alternating voltage on a direct voltage, to the second charging roller 3*b* so that the photosensitive member 1 is charged (in step S103).

The CPU 200 controls the exposure apparatus 13 so that image formation is started (in step S104). Then, until the CPU 200 outputs an instruction to end the image formation, the image forming operation is continued (in step S105).

The CPU 200 transmits an instruction to end the image formation when a predetermined job (a sequence of image forming operations for one or more recording members which are caused by an instruction to start image formation) is completed. Then, the CPU 200 stops the high-pressure output of the first and second high-voltage power supplies S1 and S2, lighting up of the before-charging exposure lamp 17, and the rotation of the photosensitive member 1 in this sequence, and ends a sequence of the image forming operations (in step S106).

The above-described control flow causes the changing potential of the photosensitive member 1 of a predetermined period (T) to be formed by using the first charging roller 3*a* during image formation. At the second charging roller 3*b*, the potential of the photosensitive member 1 before charging and the potential of the direct voltage applied to the second charging roller 3*b* cause a current to flow alternately in positive and negative directions for each predetermined period (T).

In the present embodiment, the operation of charging the photosensitive member by using the first charging roller 3*a* and the second charging roller 3*b* to form a toner image corresponds to at least steps S103 to S106 in the above-described control flow.

7. Control Timing

Figure 10:
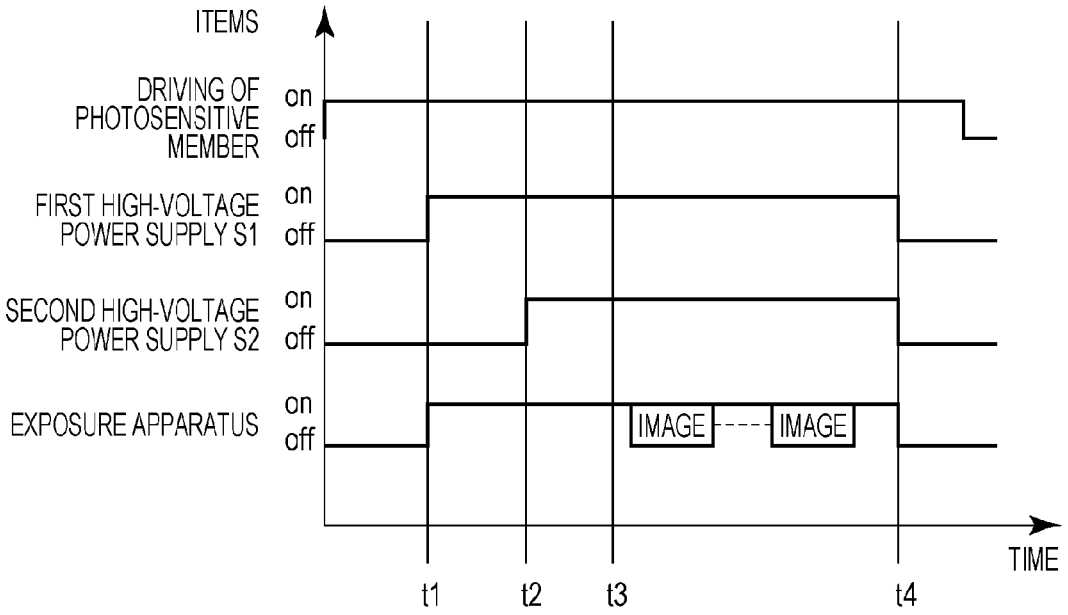
FIG. 10 is a timing chart of an image forming operation in one embodiment of the present invention.

With reference to FIG. 10, the image formation operation in the present embodiment will be described.

After the rotation of the photosensitive member 1 is stabilized, at a time point t1 (after about 500 ms), a changing voltage (direct voltage) of a predetermined period (T) is output from the first high-voltage power supply S1 to the first charging roller 3*a*, and the photosensitive member 1 is charged by using the first charging roller 3*a*.

At a time point t2 (about 700 ms), an oscillating voltage obtained by superimposing an alternating voltage on a direct voltage is output from the second high-voltage power supply S2 to the second charging roller 3*b*, and the photosensitive member 1 is charged by using the second charging roller 3*b*.

At a time point t3 (about 900 ms), image formation is started.

After the job ends at a time point t4, the high-pressure output of the first and second high-voltage power supplies S1 and S2, lighting up of the before-charging exposure lamp 17, and the rotation of the photosensitive member 1 are stopped in this sequence, and a sequence of image forming operations are ended.

As described above, occurrence of unevenness in potential caused by deposits on the second charging roller 3*b* is suppressed during image formation, achieving reduction in downtime and improvement of productivity. That is, in the present embodiment, during image formation, the changing voltage at the first charging roller 3*a* is used to change the potential of the photosensitive member 1. The potential difference from the potential of the direct voltage at the second charging roller 3*b* is used to cause a current to flow alternately in the positive and negative directions to the second charging roller 3*b*. Thus, contaminants adhering to the second charging roller 3*b* can be removed. It is not necessary to provide a cleaning mode specially, for example, in which image formation is interrupted. Therefore, downtime can be reduced and productivity of the image forming apparatus can be increased. In a configuration using multiple charging rollers, charging failure caused by contaminants on the surface of the charging roller disposed on the most downstream side is prevented, improving stability of image quality.

As described above, according to the present embodiment, without cleaning charging members by providing a special time period during which image formation cannot be performed, accumulation of deposits such as toner on the charging members can be suppressed, achieving improvement of productivity.

Second Embodiment

Another embodiment of the present invention will be described. The basic configuration and the basic operation of an image forming apparatus of the present embodiment are the same as those in the first embodiment. Therefore, in the image forming apparatus of the present embodiment, components having a function and a configuration which are the same as or correspond to those in the image forming apparatus of the first embodiment are designated with identical reference characters, and are not described in detail.

In the present embodiment, as a charge voltage applied to the first charging roller 3*a*, an oscillating voltage obtained by superimposing an alternating voltage whose period is shorter than that of a changing voltage similar to that in the first embodiment on the changing voltage is applied. This modification improves stability of the potential of the photosensitive member 1 which is formed by using the first charging roller 3*a*. Thus, while an effect similar to that in the first embodiment is achieved, more stable charge potential of the photosensitive member 1 enables high image quality to be achieved.

Figure 11:
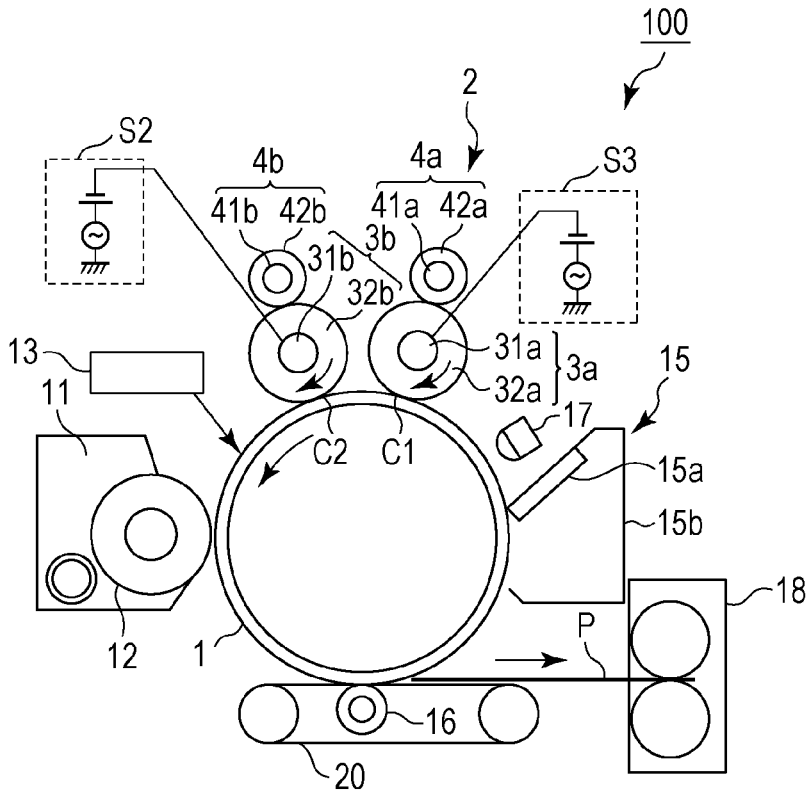
FIG. 11 is a schematic sectional view of a principal part of an image forming apparatus according to another embodiment of the present invention.
Figure 12:
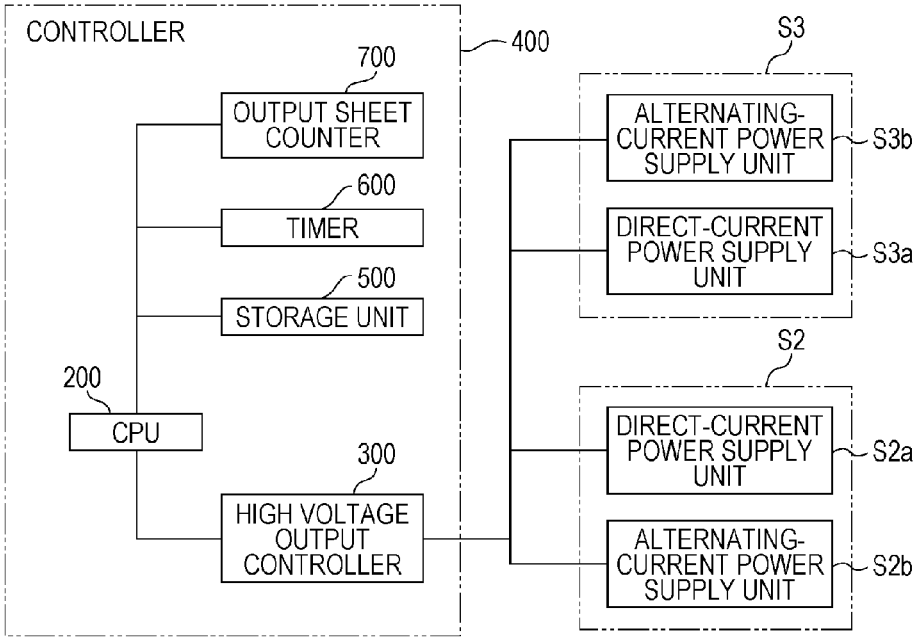
FIG. 12 is a block diagram illustrating a general control aspect of a principal part of an image forming apparatus according to another embodiment of the present invention.

FIG. 11 is a schematic sectional view illustrating the configuration of a principal part of the image forming apparatus 100 in the present embodiment. FIG. 12 is a block diagram illustrating a control aspect of the principal part of the image forming apparatus 100 in the present embodiment.

In the present embodiment, a first high-voltage power supply S3 which serves as a first power supply is connected to the core metal portion 31*a* of the first charging roller 3*a*. The first high-voltage power supply S3 includes a changing-voltage power supply unit S3*a* which supplies a changing voltage and an alternating-current power supply unit S3*b* which supplies an alternating voltage, and can apply an oscillating voltage obtained by superimposing an alternating voltage on a changing voltage to the first charging roller 3*a*. The first high-voltage power supply S3 is connected to the high voltage output controller 300.

In the present embodiment, the first high-voltage power supply S3 has a configuration common to that of the second high-voltage power supply S2.

The charging operation performed by using the first charging roller 3*a* will be described.

Figure 13A:
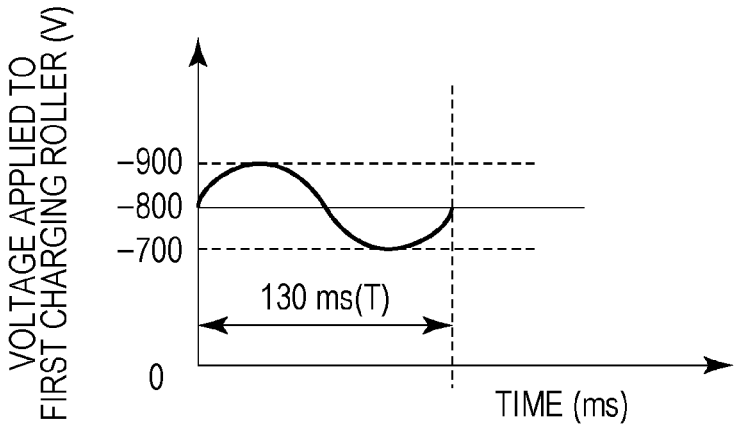
FIGS. 13A and 13B include graphs for describing a voltage applied to a first charging roller and a potential of a photosensitive member just after passing through a first charging position in another embodiment of the present invention.
Figure 13B:
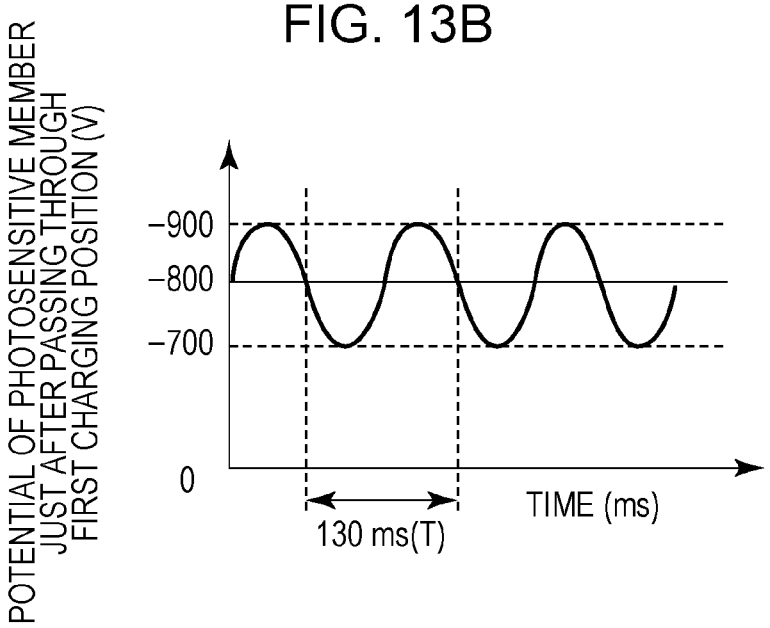

FIG. 13A illustrates a change over time in the changing voltage applied to the first charging roller 3*a*. FIG. 13B illustrates a change over time in the potential of the photosensitive member 1 just after passing through the first charging position C1.

As illustrated in FIG. 13A, a changing voltage whose median is −800 V and whose range of change is ±100 V is applied to the first charging roller 3*a*. The waveform of this voltage is a sine wave having a period (T) of 130 ms.

An alternating voltage whose voltage between peaks Vpp is 1200 V and whose frequency is 5.86 KHz is superimposed on the above-described changing voltage, and the superimposed voltage is applied to the first charging roller 3*a*. That is, an oscillating voltage whose median is −800 V is applied to the first charging roller 3*a*.

The application of this voltage causes a potential as illustrated in FIG. 13B to be formed on the surface of the photosensitive member 1 just after passing through the first charging position C1. That is, a potential (changing potential) whose median is −800 V, whose range of change is ±100 V, whose maximum value on the charge polarity side of the photosensitive member 1 is −900 V, whose minimum value is −700 V, and whose period (T) is 130 ms is formed. Thus, the first charging roller 3*a* causes formation of a charge potential which changes in a wave form in the circumferential direction of the photosensitive member 1.

The change over time in the potential of the photosensitive member 1 just before arrival at the second charging position C2 is similar to that in the first embodiment. The setting of a voltage applied to the second charging roller 3*b* is the same as that in the first embodiment.

Figure 14:
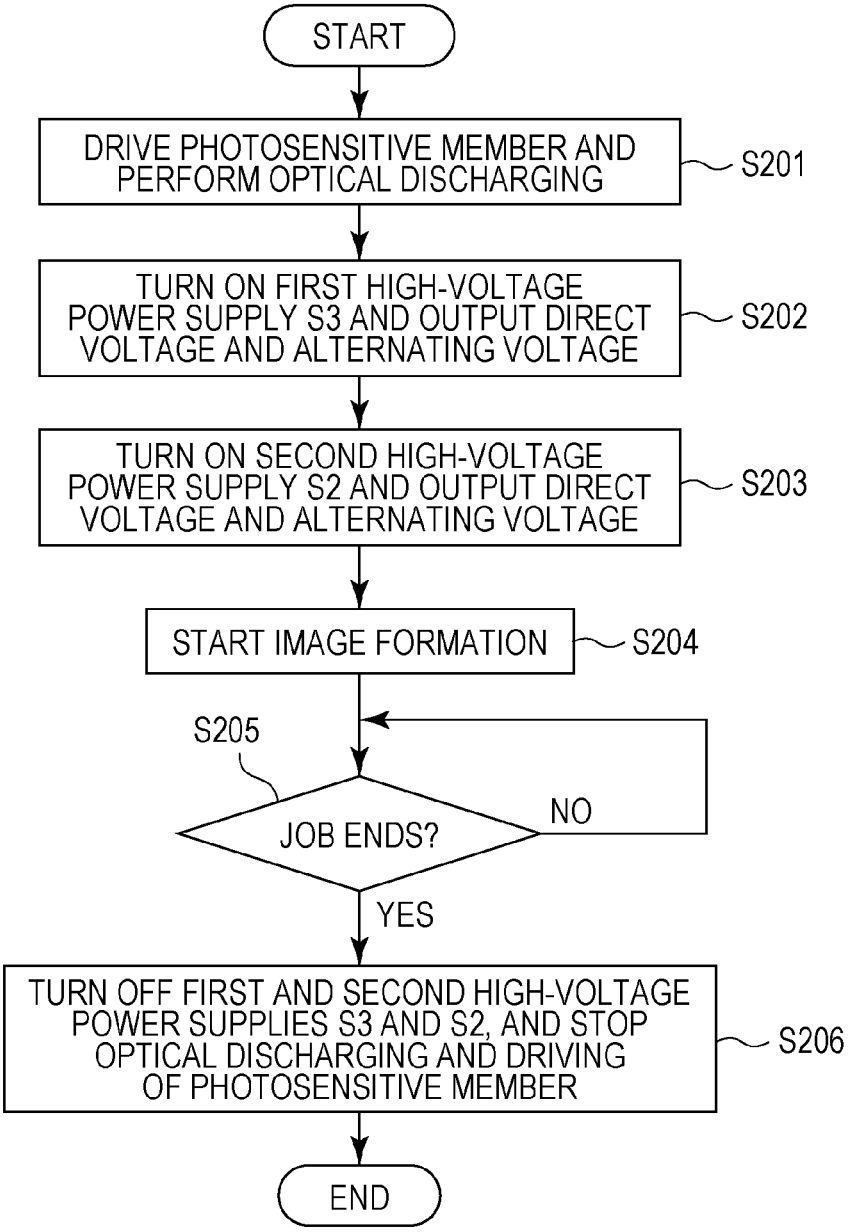
FIG. 14 is a flowchart of an image forming operation in another embodiment of the present invention.

FIG. 14 illustrates a general control flow performed when the image forming operation is performed in the present embodiment.

The processes in steps S201 to S206 in the flowchart in FIG. 14 are similar to those in steps S101 to S106 in the flowchart in FIG. 9 described in the first embodiment. However, in step S202, the process is different in that an oscillating voltage obtained by superimposing an alternating voltage on a changing voltage is output from the first high-voltage power supply S3 to the first charging roller 3*a*.

As described above, according to the present embodiment, unevenness in potential is smaller than that in the first embodiment, enabling formation of stable potential of the photosensitive member 1.

Third Embodiment

Another embodiment of the present invention will be described. The basic configuration and the basic operation of an image forming apparatus of the present embodiment are the same as those in the first embodiment. Therefore, in the image forming apparatus of the present embodiment, components having a function and a configuration which are the same as or correspond to those in the image forming apparatus of the first embodiment are designated with identical reference characters, and are not described in detail.

In the present embodiment, the central value of the changing potential of the photosensitive member 1 which is formed by using the first charging roller 3*a* is set to a value which is shifted in one direction on the positive polarity side or the negative polarity side with respect to the potential of the direct voltage applied to the second charging roller 3*b*. Thus, efficiency in removal of deposits, such as toner and external additives, on the photosensitive member 1 which are easily charged to either of the positive polarity and the negative polarity is improved.

In the present embodiment, the maximum of the absolute value of the difference between the potential (PreVD) of the photosensitive member 1 just before arrival at the second charging position C2 and the potential (Vdc) of the direct voltage applied to the second charging roller 3*b* (=PreVD−Vdc) on the positive side is set to be larger than that on the negative side.

Figure 15A:
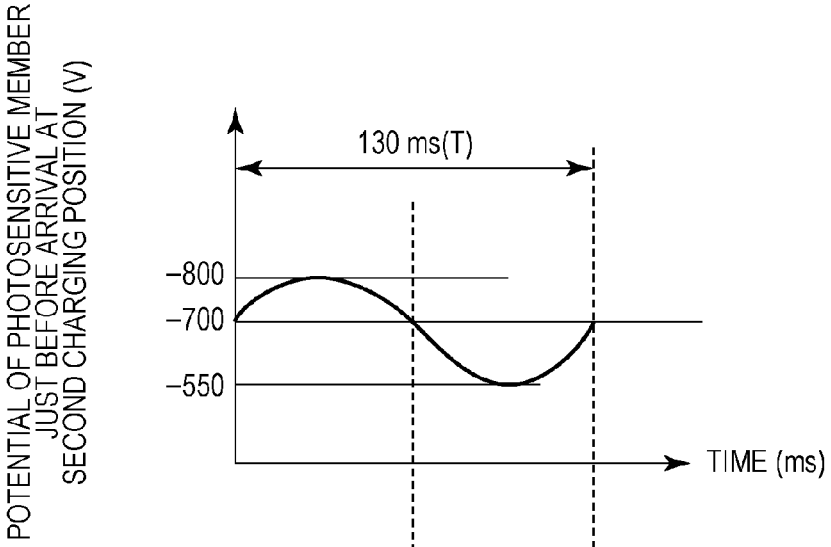
FIGS. 15A and 15B include graphs for describing a current which flows to a second charging roller in yet another embodiment of the present invention.
Figure 15B:
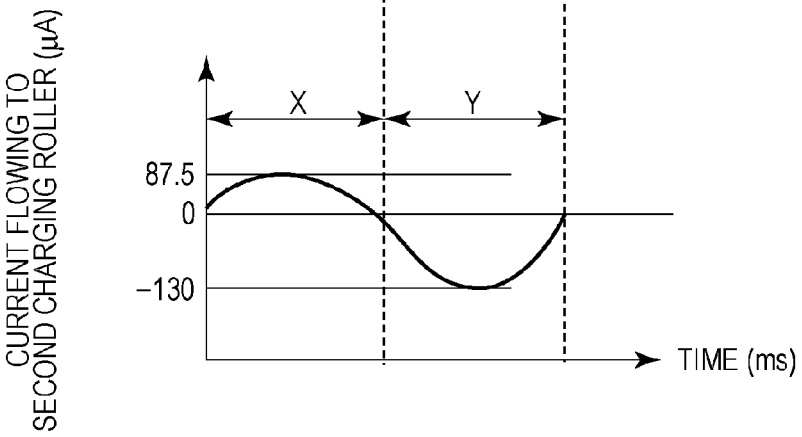

FIG. 15A illustrates a change over time in the potential of the photosensitive member 1 just before arrival at the second charging position C2. FIG. 15B illustrates a change over time in the current which flows to the second charging roller 3*b*.

As illustrated in FIG. 15A, the potential of the photosensitive member 1 just before arrival at the second charging position C2 has a median of −700 V, a maximum on the charge polarity side of the photosensitive member 1 of −800 V, and a minimum of −550 V. That is, in the present embodiment, the amplitude of the potential of the photosensitive member 1 in a period corresponding to Y is set to be larger than that in a period corresponding to X.

The setting of the voltage applied to the second charging roller 3*b* is the same as that in the first embodiment, and the direct voltage applied to the second charging roller 3*b* is −700 V.

For the difference between the potential of the photosensitive member 1 just before arrival at the second charging position C2 and the potential of the direct voltage applied to the second charging roller 3*b*, the maximum on the negative side, the maximum on the positive side, and the relation between the absolute values of these are as follows. The maximum on the negative side: (−800)−(−700)=−100 (V) The maximum on the positive side: (−550)−(−700)=+150 (V) |the maximum on the negative side|<|the maximum on the positive side|=|−100|<|150|

As in the first embodiment, both of X and Y are 65 ms, which is 1.25 times the rotation period of the second charging roller 3*b*.

Thus, as illustrated in FIG. 15B, a current which flows to the second charging roller 3*b* in the negative direction is larger than that in the positive direction. In the present embodiment, the maximum in the positive direction in the current which flows to the second charging roller 3*b* in an X period is 87.5 μA, and the maximum in the negative direction in the current which flows to the second charging roller 3*b* in a Y period is −130 μA.

That is, in the present embodiment, the maximum of the absolute value of the difference between the potential of the photosensitive member 1 which alternately switches during image formation and the potential of the direct voltage applied to the second charging roller 3*b*, on the negative side is different from that on the positive side.

Through such a setting, a current which flows to the second charging roller 3*b* in the negative direction is larger than that in the positive direction. That is, deposits charged to the negative polarity are easily moved to the photosensitive member 1 side. Therefore, deposits, such as toner and external additives, on the photosensitive member 1 which passes through the second charging position C2 can be biased on the negative polarity side. In addition, a current in the positive direction which is caused by the changing potential of the photosensitive member 1 also flows to the second charging roller 3*b*. Therefore, accumulation of deposits charged to the positive polarity onto the second charging roller 3*b* can be also suppressed, and stable image formation can be achieved.

In the present embodiment, a current which flows to the second charging roller 3*b* in the negative direction is larger than that in the positive direction. However, in accordance with the charge polarities of toner, external additives, and the photosensitive member 1, modification can be made as appropriate to whether a current in the positive direction or that in the negative direction is to be larger, and the ratio of a current in the negative direction to that in the positive direction.

Fourth Embodiment

Another embodiment of the present invention will be described. The basic configuration and the basic operation of an image forming apparatus of the present embodiment are the same as those in the first embodiment. Therefore, in the image forming apparatus of the present embodiment, components having a function and a configuration which are the same as or correspond to those in the image forming apparatus of the first embodiment are designated with identical reference characters, and are not described in detail.

In the present embodiment, the time period X in which the difference between the potential of the photosensitive member 1 just before arrival at the second charging position C2 and the potential of the direct voltage applied to the second charging roller 3*b* is a negative side value is set to be a value different from the time period Y in which the difference is a positive side value (the ratio of X to Y is shifted from 1:1). Thus, efficiency in removal of deposits, such as toner and external additives, on the photosensitive member 1 which are easily charged to either of the positive polarity and the negative polarity is improved.

In the present embodiment, the changing potential of the photosensitive member 1 which is formed by using the first charging roller 3*a* is set so that a current which flows in the positive direction to the second charging roller 3*b* flows for a longer time than that in the negative direction.

Figure 16A:
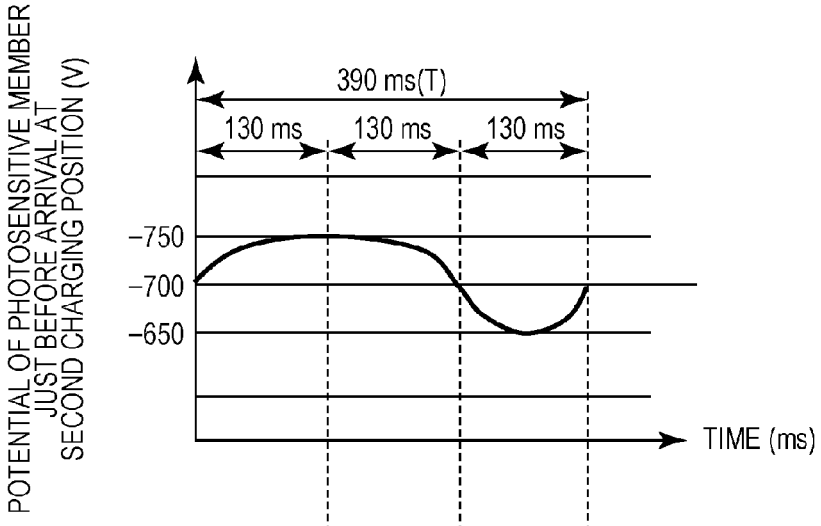
FIGS. 16A and 16B include graphs for describing a current which flows to a second charging roller in yet another embodiment of the present invention.
Figure 16B:
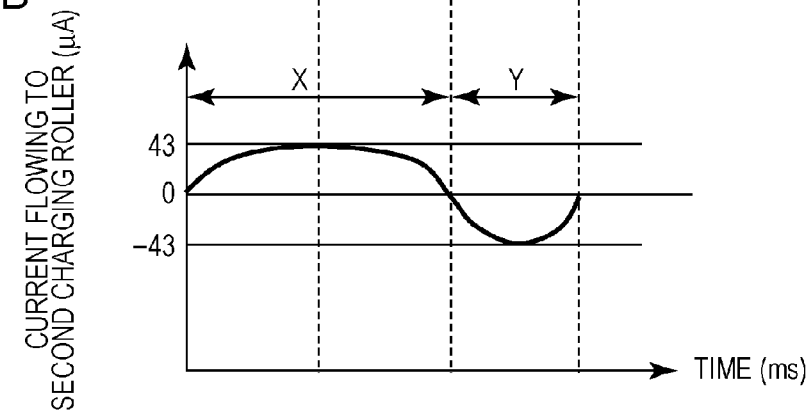

FIG. 16A illustrates a change over time in the potential of the photosensitive member 1 just before arrival at the second charging position C2. FIG. 16B illustrates a change over time in the current which flows to the second charging roller 3*b*.

As illustrated in FIG. 16A, the changing potential of the photosensitive member 1 just before arrival at the second charging position C2 has a median of −700 V, a range of change of ±50 V, a maximum of −750 V on the charge polarity side of the photosensitive member 1, and a minimum of −650 V.

The setting of a voltage applied to the second charging roller 3*b* is the same as that in the first embodiment, and the direct voltage applied to the second charging roller 3*b* is −700 V.

The time period X in which the difference between the potential of the photosensitive member 1 just before arrival at the second charging position C2 and the potential of the direct voltage applied to the second charging roller 3*b* is a negative side value is set to be a value different from the time period Y in which the difference is a positive side value, and the ratio of X to Y is set to 2:1. In the present embodiment, X is set to 260 ms, and Y is set to 130 ms.

Thus, the period ratio of the time period X in which a current flows in the positive direction to the second charging roller 3*b* to the time period Y in which a current flows in the negative direction is biased to 2:1. In the present embodiment, the maximum of the current which flows in the positive direction to the second charging roller 3*b* in an X period is 43 μA, and the maximum of the current which flows in the negative direction to the second charging roller 3*b* in a Y period is −43 μA.

That is, in the present embodiment, a time period for which the difference between the potential of the photosensitive member 1 which is alternately switched during image formation and the potential of the direct voltage applied to the second charging roller 3*b* is a negative side value is represented by X (s), and a time period for which the difference is a positive side value is represented by Y (s). The ratio of X to Y is biased to X or Y.

Through such a setting, a time period for which a current flows in the positive direction to the second charging roller 3*b* can be set to be longer than that in the negative direction. That is, deposits charged to the positive polarity are easily moved to the photosensitive member 1 side. Therefore, accumulation of deposits, such as toner and external additives, on the photosensitive member 1 which are charged to the positive polarity onto the second charging roller 3*b* can be more easily reduced. A current in the negative direction which is caused by the changing potential of the photosensitive member 1 also flows to the second charging roller 3*b*. Therefore, accumulation of deposits charged to the negative polarity onto the second charging roller 3*b* can be also suppressed, and stable image formation can be performed.

In the present embodiment, a time period for which a current flows in the positive direction to the second charging roller 3*b* is set to be larger than that in the negative direction. However, in accordance with the charge polarities of toner, external additives, and the photosensitive member 1, modification can be made as appropriate to whether a current in the positive direction or that in the negative direction is to be larger, and the ratio of a current in the negative direction to that in the positive direction.

The period ratio of the X time period for which a current flows in the positive direction to the Y time period for which a current flows in the negative direction may be changed at every predetermined number of output sheets, by using the output sheet counter 700 or the like provided for the image forming apparatus 100. For example, after printing is started, control is exerted so that the period ratio of X to Y is set to 2:1 for a period for up to 1000 A4 sheets of landscape orientation. After that, switching is performed so that the period ratio of X to Y is set to 3:1. Thus, under a condition of continuous output of sheets, the number of which is equal to or more than 1000, deposits which are charged to the positive polarity and which are accumulated on the second charging roller 3*b* can be further reduced. Therefore, a better effect of suppressing accumulation of deposits with the positive charge polarity onto the second charging roller 3*b* can be achieved.

Fifth Embodiment

Another embodiment of the present invention will be described. The basic configuration and the basic operation of an image forming apparatus of the present embodiment are the same as those in the first embodiment. Therefore, in the image forming apparatus of the present embodiment, components having a function and a configuration which are the same as or correspond to those in the image forming apparatus of the first embodiment are designated with identical reference characters, and are not described in detail.

The present embodiment is a modified embodiment of the fourth embodiment.

In the present embodiment, in the configuration of the fourth embodiment, the maximum or the minimum of the changing potential formed on the photosensitive member 1, on the charge polarity side of the photosensitive member 1 is set to a value which is independently shifted to the positive polarity side or the negative polarity side.

In the present embodiment, by independently changing the maximum or the minimum of the potential of the photosensitive member 1 just before arrival at the second charging position C2, on the charge polarity side of the photosensitive member 1, the amount of an current which flows in the positive direction or the negative direction to the second charging roller 3*b* can be adjusted. Thus, in the case where deposits, such as toner and external additives, on the photosensitive member 1, which are easily charged to either of the positive polarity and the negative polarity are present, even when the charge polarity of the deposits is biased or when the amount of deposits is large, the removal efficiency can be adjusted.

In the present embodiment, the maximum of the changing potential of the photosensitive member 1 which is formed by using the first charging roller 3*a*, on the charge polarity side of the photosensitive member 1 is set to be biased on the negative polarity side with respect to the potential of the direct voltage applied to the second charging roller 3*b* compared with the maximum in the fourth embodiment.

In the present embodiment, in the change over time in the potential of the photosensitive member 1 just before arrival at the second charging position C2 as illustrated in FIG. 16A described in the fourth embodiment, the maximum on the charge polarity side of the photosensitive member 1 is biased on the negative polarity side compared with that in the fourth embodiment, and is changed to −850 V. The minimum on the charge polarity of the photosensitive member 1 remains to be the same value, −650 V, as that in the fourth embodiment.

The setting of the voltage applied to the second charging roller 3*b* is the same as that in the first embodiment, and the direct voltage applied to the second charging roller 3*b* is −700 V.

Thus, in the change over time in the current which flows to the second charging roller 3*b* as illustrated in FIG. 16B described in the fourth embodiment, the maximum of the current which flows in the positive direction in an X period is changed to 86 μA which is larger than that in the fourth embodiment. The maximum of the current which flows in a Y period remains to be −43 μA which is the same as that in the fourth embodiment.

Thus, compared with the fourth embodiment, deposits which are charged to the positive polarity and which adhere to the second charging roller 3*b* can be reduced.

In the present embodiment, only the maximum of the changing potential of the photosensitive member 1, on the charge polarity side of the photosensitive member 1 is increased. However, only the minimum on the charge polarity side of the photosensitive member 1 is changed so that the current which flows in the negative direction to the second charging roller 3*b* is increased.

The potential difference between the maximum or the minimum of the changing potential of the photosensitive member 1, on the charge polarity side of the photosensitive member 1 and the direct voltage applied to the second charging roller 3*b* can be changed as appropriate in accordance with, for example, the polarity of toner and the external additive which are used in the image forming apparatus 100.

Sixth Embodiment

Another embodiment of the present invention will be described. The basic configuration and the basic operation of an image forming apparatus of the present embodiment are the same as those in the first embodiment. Therefore, in the image forming apparatus of the present embodiment, components having a function and a configuration which are the same as or correspond to those in the image forming apparatus of the first embodiment are designated with identical reference characters, and are not described in detail.

In the present embodiment, the maximum and the minimum of the changing potential formed on the photosensitive member 1, on the charge polarity side of the photosensitive member 1 are changed at every predetermined number of output sheets. That is, in the present embodiment, the CPU 200 which serves as control means switches the maximum and the minimum of the changing voltage applied to the first charging roller 3*a* on the basis of the number of sheets on which images are formed. Thus, the potential difference in the changing potential formed on the photosensitive member 1 is periodically changed, and the magnitude of the a current which flows in the positive and negative directions to the second charging roller 3*b* is changed, improving the effect of removing deposits on the second charging roller 3*b*. That is, by alternately switching the range of change of the changing potential periodically, a current which flows in the positive and negative directions from the second charging roller 3*b* to the photosensitive member 1 can be periodically increased. Thus, low charged deposits which are charged to the positive polarity and the negative polarity and which could not be removed by using a small changing potential can be removed by providing a large changing current periodically. Therefore, accumulation of deposits can be further suppressed, and the effect of removing deposits is increased.

In the first embodiment, as illustrated in FIG. 4A, the range of change in the changing voltage applied to the first charging roller 3*a* is fixed at ±100 V. In contrast, in the present embodiment, the range of change in the changing voltage applied to the first charging roller 3*a* is switched at every predetermined number of output sheets.

In the present embodiment, the changing voltage applied to the first charging roller 3*a* has a median of −1200 V, and two ranges of change of ±75 V and ±150 V. The output sheet counter 700 is used to switch the range of change at every 1000 image output sheets.

In the present embodiment, the range of change in the changing voltage applied to the first charging roller 3*a* is changed in such a manner that the range in change on the positive polarity side is equal to that on the negative polarity side. However, the range of change may be changed in such a manner that the range in change on the positive polarity side is different from that on the negative polarity side.

Figure 17:
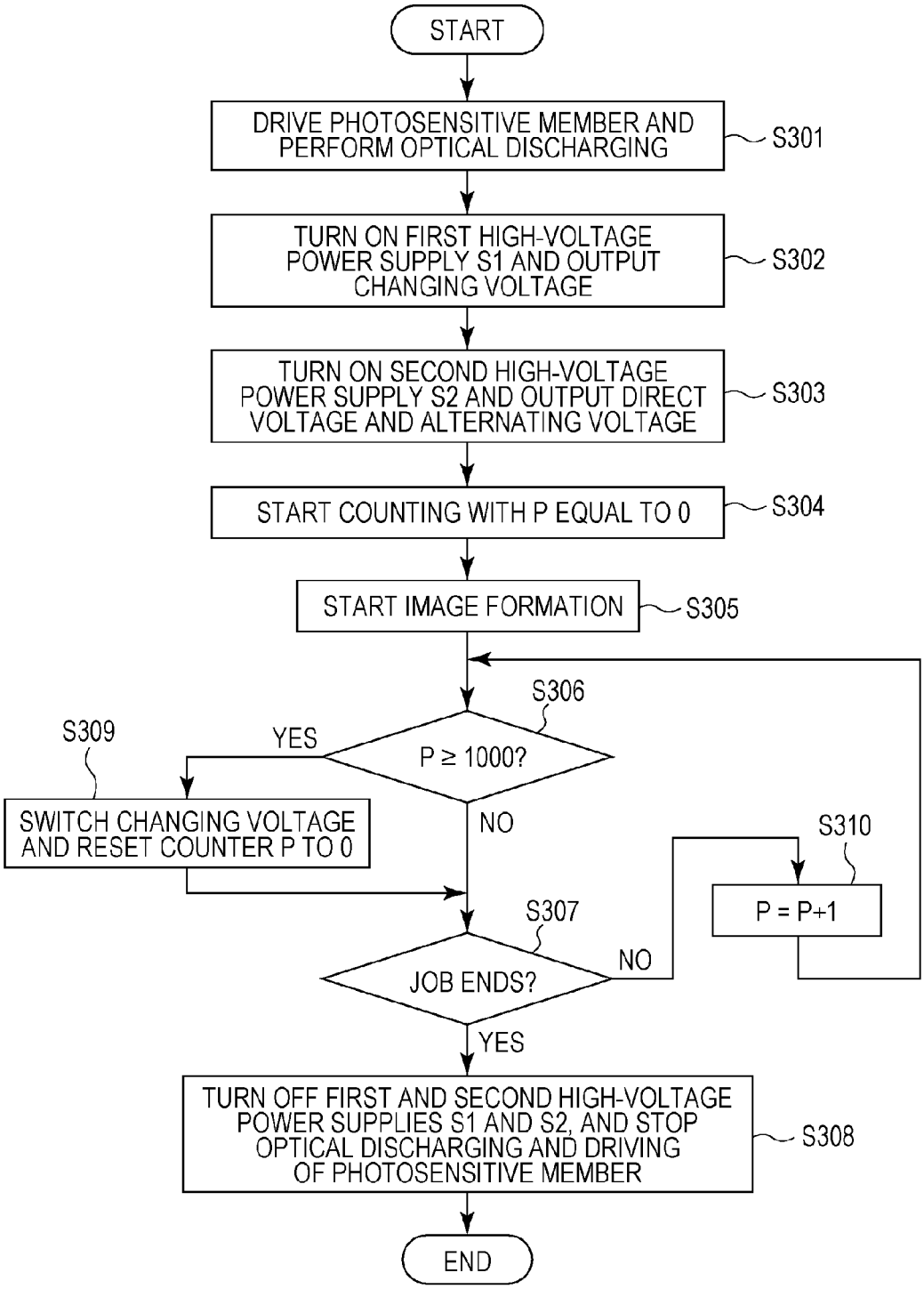
FIG. 17 is a flowchart of an image forming operation in yet another embodiment of the present invention.

With reference to FIG. 17, a control flow performed when an image forming operation is performed in the present embodiment will be described.

The CPU 200 controls the image forming apparatus 100 by using the following procedure when an image formation signal is input.

Receiving the image formation signal, the CPU 200 rotates the photosensitive member 1, and exposes the photosensitive member 1 to light by using the before-charging exposure lamp 17 (in step S301).

At the timing when steady rotation reached by the photosensitive member 1 is detected, the CPU 200 causes the first high-voltage power supply S1 to output a changing voltage (direct voltage) of the predetermined period (T) to the first charging roller 3*a* so that the photosensitive member 1 is charged (in step S302). At that time, the range of change in the changing voltage is set to ±75 V.

The CPU 200 causes the second high-voltage power supply S2 to output an oscillating voltage obtained by superimposing an alternating voltage on a direct voltage, to the second charging roller 3*b* so that the photosensitive member 1 is charged (in step S303).

The CPU 200 resets the number of counted sheets P of the output sheet counter 700 which is used to switch the potentiodynamism, to 0 (in step S304).

The CPU 200 controls the exposure apparatus 13 so that image formation is started (in step S305).

The CPU 200 determines whether or not the number of counted sheets P reaches 1000 (in step S306).

If the number of counted sheets P is less than 1000 in step S306, the CPU 200 determines whether or not the job is ended (in step S307).

If it is determined that the job is ended in step S307, the CPU 200 stops the high-pressure output of the first and second high-voltage power supplies S1 and S2, lighting up of the before-charging exposure lamp 17, and the rotation of the photosensitive member 1 in this sequence, and ends a sequence of the image forming operations (in step S308).

If it is determined that the job is continued in step S307, after the number of counted sheets P is incremented (in step S310), the process proceeds to step S306. This operation is repeated until the job is ended.

If it is determined that the number of counted sheets P is equal to or more than 1000 in step S306, the CPU 200 switches the range of change in the changing voltage applied to the first charging roller 3*a* to ±150 V, and resets the number of counted sheets P of the counter 700 to 0 (in step S309). The process proceeds to step S307, and the CPU 200 determines whether or not the job is ended.

If the job is continued, the range of change is alternately switched between ±75 V and ±150 V every time the number of counted sheets P of the counter 700 reaches 1000.

The above-described operations cause the range of change in the changing potential of the photosensitive member 1 to be switched at every predetermined number of output sheets. That is, in the present embodiment, the control means 200 periodically switches the maximum of the absolute value of the difference between the potential of the photosensitive member 1 which has reached the second charging position C2 and the potential of the direct voltage applied to the second charging roller 3*b*. Thus, the effect of removing deposits on the second charging roller 3*b* is improved.

In the present embodiment, the range of change in the changing voltage applied to the first charging roller 3*a* is changed in accordance with the number of image output sheets which is counted by the counter 700. However, the present invention is not limited to this. For example, it is possible to use the timer 600 to measure an image formation time, a time of rotation of a rotatable member, such as the photosensitive member 1, the first charging roller 3*a*, or the second charging roller 3*b*, a time of voltage application to the first charging roller 3*a* or the second charging roller 3*b*, or the like. In accordance with the measurement result, the range of change in the changing voltage applied to the first charging roller 3*a* may be changed. That is, the range of change may be changed in accordance with information having correlation to the amount of usage of the first and second charging members 3*a* and 3*b*.

According to the present invention, accumulation of deposits such as toner onto a charging member can be suppressed without cleaning the charging member by providing a special period during which an image cannot be formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An image forming apparatus comprising:

a rotatable photosensitive member;

a first charging roller for charging the photosensitive member;

a second charging roller for charging the photosensitive member on the downstream side of the first charging roller in a rotation direction of the photosensitive member;

a toner image forming unit disposed on the downstream side of the second charging roller in the rotation direction of the photosensitive member, the toner image forming unit forming a latent image on a surface of the photosensitive member which has been charged by using the first charging roller and the second charging roller, and developing the latent image by using toner so as to form a toner image;

a first power supply that applies a changing voltage to the first charging roller, a voltage value of the changing voltage being made to change;

a second power supply that applies a voltage obtained by superimposing an alternating voltage on a direct voltage, to the second charging roller; and control means for changing the changing voltage applied from the first power supply to the first charging roller in such a manner that a magnitude relationship between a potential of the photosensitive member which has been charged by using the first charging roller and which has reached a position at which the photosensitive member is charged by using the second charging roller, and the direct voltage applied to the second charging roller is alternately switched, when the photosensitive member is to be charged by using the first charging roller and the second charging roller to form a toner image, wherein, when the photosensitive member is to be charged by using the first charging roller and the second charging roller to form a toner image, the following relations are satisfied, $$X>(W/PS), Y>(W/PS),$$

where X (s) represents a time period for which the potential of the surface of the photosensitive member which has been charged by using the first charging roller and which has reached a position at which the photosensitive member is charged by using the second charging roller is less than the direct voltage applied to the second charging roller, Y (s) represents a time period for which the potential is more than the direct voltage, PS (mm/s) represents a peripheral velocity of the photosensitive member, and W (mm) represents a width of a contact portion between the second charging roller and the photosensitive member in the rotation direction of the photosensitive member, and wherein a sum of X and Y is larger than a period of the alternating voltage applied to the second charging roller.

2. The image forming apparatus according to claim 1, wherein a non-integer multiple relationship is present between X and a rotation period of the second charging roller, between Y and the rotation period of the second charging roller, and between the sum of X and Y and the rotation period of the second charging roller, when the photosensitive member is to be charged by using the first charging roller and the second charging roller to form a toner image.

3. The image forming apparatus according to claim 1, wherein the following relation is satisfied, $$|VHI-VLO|<2|Vdc|,$$

where VHI represents a maximum of the potential of the surface of the photosensitive member which has been charged by using the first charging roller and which has reached a position at which the photosensitive member is charged by using the second charging roller, VLO represents a minimum of the potential, and Vdc represents the direct voltage applied to the second charging roller.

4. The image forming apparatus according to claim 1, wherein the control means switches a maximum and a minimum of the changing voltage on the basis of the number of image-formed sheets.

* * * * *